US011104028B2

(12) United States Patent
Burke et al.

(10) Patent No.: US 11,104,028 B2
(45) Date of Patent: Aug. 31, 2021

(54) FENCES FOR TABLE SAWS

(71) Applicant: SD3, LLC, Tualatin, OR (US)

(72) Inventors: Jeremy J. Burke, Sherwood, OR (US); John P. Nenadic, Camas, WA (US); Stephen F. Gass, West Linn, OR (US); J. David Fulmer, West Linn, OR (US); Paul H. Stasiewicz, Oregon City, OR (US)

(73) Assignee: SawStop Holding LLC, Tualatin, OR (US)

( * ) Notice: Subject to any disclaimer, the term of this patent is extended or adjusted under 35 U.S.C. 154(b) by 342 days.

(21) Appl. No.: 14/829,177

(22) Filed: Aug. 18, 2015

(65) Prior Publication Data

US 2016/0046034 A1 Feb. 18, 2016

Related U.S. Application Data

(60) Provisional application No. 62/038,645, filed on Aug. 18, 2014.

(51) Int. Cl.
*B27B 27/02* (2006.01)

(52) U.S. Cl.
CPC ..... *B27B 27/02* (2013.01)

(58) Field of Classification Search
CPC ..... B27B 27/02; B27B 27/04; B27B 27/06; B27B 27/08; B27B 27/10; Y10T 83/6584; Y10T 83/6622
See application file for complete search history.

(56) References Cited

U.S. PATENT DOCUMENTS

| | | | | | |
|---|---|---|---|---|---|
| 13,670 | A | * | 10/1855 | Worden | B27B 27/02 83/438 |
| 544,787 | A | * | 8/1895 | Heath | B43L 7/125 33/454 |
| 785,699 | A | * | 3/1905 | Bemis | B27B 27/02 144/307 |
| 816,424 | A | * | 3/1906 | Bemis | B27B 27/02 144/307 |
| 836,006 | A | * | 11/1906 | Bemis | B27B 27/02 100/257 |
| 1,938,548 | A | | 12/1933 | Tautz | |
| 1,963,688 | A | | 6/1934 | Tautz | |
| 1,993,219 | A | | 3/1935 | Merrigan | |

(Continued)

OTHER PUBLICATIONS

SI16WA-WF Circular Saw with Tilting Blade Spare Parts Catalogue, SCMI Corporation, Norcross, GA, Nov. 1986 and 1991.

(Continued)

*Primary Examiner* — Jonathan G Riley

(57) ABSTRACT

Fences for use in table saws are disclosed. One embodiment may include an actuator, handle or lever to lock and unlock the fence from the table, where the actuator, handle or lever is positioned substantially above the tabletop and substantially within the perimeter of the table (including any rail associated with the table). Another embodiment may include an actuator, handle or lever to lock and unlock the fence from the table, where the actuator, handle or lever is positioned along a top surface of the fence and configured so that the fence unclamps from the saw when the actuator, handle or lever is pressed. The fence may be configured to include a material support shelf that is selectably extendable and retractable.

14 Claims, 17 Drawing Sheets

(56) References Cited

U.S. PATENT DOCUMENTS 2,075,282 A 3/1937 Hedgpeth
2,106,288 A 1/1938 Tautz
2,556,548 A 6/1951 Modderman
2,560,996 A * 7/1951 Stone ..... B23Q 3/005 144/253.1
2,590,035 A 3/1952 Pollak
2,622,637 A 12/1952 Gustin
2,695,638 A 11/1954 Gaskell
2,739,625 A * 3/1956 Peters ..... B27B 25/10 83/425
2,759,503 A * 8/1956 Goldschmidt ..... B27B 25/10 269/165
2,852,047 A 9/1958 Odlum et al.
2,945,516 A 7/1960 Edgemond, Jr. et al.
3,011,531 A 12/1961 Gaskell
3,021,881 A 2/1962 Edgemond, Jr. et al.
3,565,137 A 2/1971 Alsruhe
3,845,676 A 11/1974 Pierce
3,953,770 A 4/1976 Hayashi
4,206,910 A 6/1980 Biesemeyer
4,294,147 A 10/1981 Borzym
4,593,590 A * 6/1986 Gray ..... B27B 27/10 83/435.2
4,793,604 A * 12/1988 Taylor ..... B23Q 16/08 269/303
4,817,482 A * 4/1989 Dunaway, Jr. ..... B27B 27/02 83/438
4,964,450 A 10/1990 Hughes et al.
5,116,249 A 5/1992 Shiotani et al.
5,228,374 A * 7/1993 Santeramo, Sr. ..... B27B 27/02 83/438
5,230,269 A 7/1993 Shiotani et al.
5,293,802 A 3/1994 Shiontani et al.
5,379,816 A 1/1995 Charlton
5,402,581 A * 4/1995 Hurd ..... B23Q 3/005 33/471
5,464,184 A 11/1995 Folci
5,617,909 A * 4/1997 Duginske ..... B27B 25/10 144/253.1
5,647,258 A 7/1997 Brazell et al.
5,722,308 A 3/1998 Ceroll et al.
5,816,129 A * 10/1998 Singer ..... B27B 27/06 83/468.3
5,927,857 A 7/1999 Ceroll et al.
D422,290 S 4/2000 Welsh et al.
6,062,121 A 5/2000 Ceroll et al.
6,148,703 A 11/2000 Ceroll et al.
6,161,459 A 12/2000 Ceroll et al.
6,250,190 B1 6/2001 Ceroll et al.
6,357,328 B1 3/2002 Ceroll et al.
6,450,077 B1 9/2002 Ceroll et al.
6,460,442 B2 10/2002 Talesky et al.
6,484,614 B1 11/2002 Huang
6,484,767 B2 11/2002 Cameron
6,575,067 B2 6/2003 Parks et al.
6,581,655 B2 6/2003 Huang
6,601,493 B1 8/2003 Crofutt
D479,538 S 9/2003 Welsh et al.
6,640,683 B2 11/2003 Lee
6,644,157 B2 11/2003 Huang
6,647,847 B2 11/2003 Hewitt et al.
6,736,042 B2 5/2004 Behne et al.
6,854,371 B2 2/2005 Yu
6,986,370 B1 1/2006 Schoene et al.
7,127,976 B1 * 10/2006 Fitzsimmons ..... B23D 47/045 144/204.2
7,360,476 B2 * 4/2008 Berthiaume ..... B23D 47/04 83/465
2002/0050201 A1 5/2002 Lane et al.
2003/0150309 A1 * 8/2003 Goodwin ..... B27B 27/02 83/435.12
2005/0087049 A1 4/2005 Miller
2006/0053992 A1 * 3/2006 Williams ..... B27G 5/023 83/435.12
2006/0130623 A1 6/2006 Ceroll et al.
2006/0201297 A1 * 9/2006 Friend ..... B27B 25/02 83/436.1
2008/0236355 A1 10/2008 Gass et al.
2012/0055307 A1 * 3/2012 Burke ..... B27B 27/02 83/446

OTHER PUBLICATIONS

Inca 2100SE Professional Tablesaw Owners Manual, Injecta Machinery, 1992.
Skil Model 3400-Type 1 10" Table Saw Parts List and Technical Bulletin, S-B Power Tool Company, Jun. 1993.
*Building a Clone of a Biesemeyer Table Saw Fence*, Swensen, 1996, 2006.
Shop Fox® Fence Operating Manual, Woodstock International, Inc., 1996, revised May 1997.
SI320 Circular with Tilting Blade Spare Parts Catalogue, SCM, Dec. 23, 1998.
SI3200/3800 Circular with Tilting Blade Spare Parts Catalogue, SCM, Dec. 23, 1998.
Grizzly Industrial, Inc. Heavy-Duty 12" Table Saw Model G5959 and G9957 Parts List, 1998 and Oct. 2001.
Excaliber T-Slot Precision Saw Fence Model TT45 Owner's Manual, Sommerville Design & Manufacturing, Inc., May 2000.
SI300N Circular with Tilting Blade Spare Parts Catalogue, SCM, Jun. 12, 2000.
Bosch Model 4000 Worksite Table Saw Operating/Safety Instructions, S-B Power Tool Company, Jul. 2000.
SI400N Circular with Tilting Blade Spare Parts Catalogue, SCM, Sep. 19, 2000.
DeWalt Woodworker's Table Saw DW746 Instruction Manual, DeWalt Industrial Tool Co., 2000.
SC 3W Circular Saw Manual, SCM Group S.p.A Divisione Minimax—Samco, Feb. 2001.
Ryobi 10" Table Saw BT3000 Operator's Manual, Ryobi Technologies, Inc., Mar. 2001.
XACTA Fence II™ Homeshop 30/52 Owner's Manual, JET Equipment & Tools, Mar. 2001.
XACTA Fence II™ Commercial 30/50 Owner's Manual, JET Equipment & Tools, Mar. 2001.
SI450E Circular with Tilting Blade Spare Parts Catalogue, SCM, Apr. 26, 2001.
Bosch 10" Table Saw Model 0601476139 Parts List and Technical Bulletin, S-B Power Tool Company, Apr. 2001.
Biesemeyer® T-Square® Universal Home Shop Fence system Instruction Manual, Delta Machinery, Jun. 1, 2001.
Powermatic 10" Tilting Arbor Saw Model 66 Instruction Manual & Parts List, Jet Equipment & Tools, Jun. 2001.
Powermatic Accu-Fence for the Models 66, 72A & 74A Table Saws, Instruction Manual & Parts List, Jet Equipment & Tools, at least as early as 2002.
Skil Model 3400 Table Saw Operating/Safety Instructions, S-B Power Tool Co., Sep. 2001.
Ryobi 10" Table Saw BT3100 Operator's Manual, Ryobi Technologies, Inc., Aug. 2002.
Rojek Circular Saw PK 300 Spare part catalogue, Apr. 14, 2003.
Ridgid TS3650 Operators Manual 10" Cast Iron Table Saw, May 2003, Jun. 2003 and Jul. 15, 2003.
Porter-Cable Double Insulated 10" Bench Top Table Saw Instruction Manual, Porter-Cable Corporation, Sep. 15, 2003.
SI300S-SI300S4 Circular with Tilting Blade Spare Parts Catalogue, SCM, Oct. 30, 2003.
INCRA Incremental Micro Precision Table Saw Fence Owner's Manual, Taylor Design Group, Inc., 2003.
Craftsman® Power and Hand Tools, pp. 142-143, 2003.
Shop Fox® Models W2005, W2006, W2007 Classic Fence Instruction Manual, Woodstock International, Jan. 2000, revised Mar. 2004.
ACCU-FENCE® 64A Fence and Rail System Owner's Manual, WMH Tool Group, Sep. 2004.

(56) References Cited

OTHER PUBLICATIONS

Unifence™ Saw Guide Instruction Manual, Delta Machinery, Feb. 22, 2005.
Biesemeyer® T-Square® Commercial Fence System Instruction Manual, Delta Machinery, May 2, 2005.
Powermatic WMH Tool Group Operating Instructions and Parts Manual 10-inch Cabinet Saw Model 2000, Nov. 2005.
Makita Model 2704 Exploded Drawings and Parts List, Nov. 2005.
Porter-Cable 10" Portable Table Saw 3812, Porter-Cable Corporation, 2005.
Porter Cable 10" Portable Table Saw Model 3812 Parts List with Guard Exploded View, 2005.
Grizzly Industrial, Inc. Model G0605X/G0606X Extreme Series 12" Table Saw Owner's Manual, Grizzly Industrial, Inc., Oct. 2006.
SCM SI 450 Circular saw with tilting blade product brochure, Villa Verucchio, Italy, undated.
SCM Group publication, Rimini, Italy, undated.
Makita Table Saw 2704 Instruction Manual, Makita Corporation of America, date unknown.
Laguna Tools table saw owner's manual, date unknown.

* cited by examiner

Fig. 20
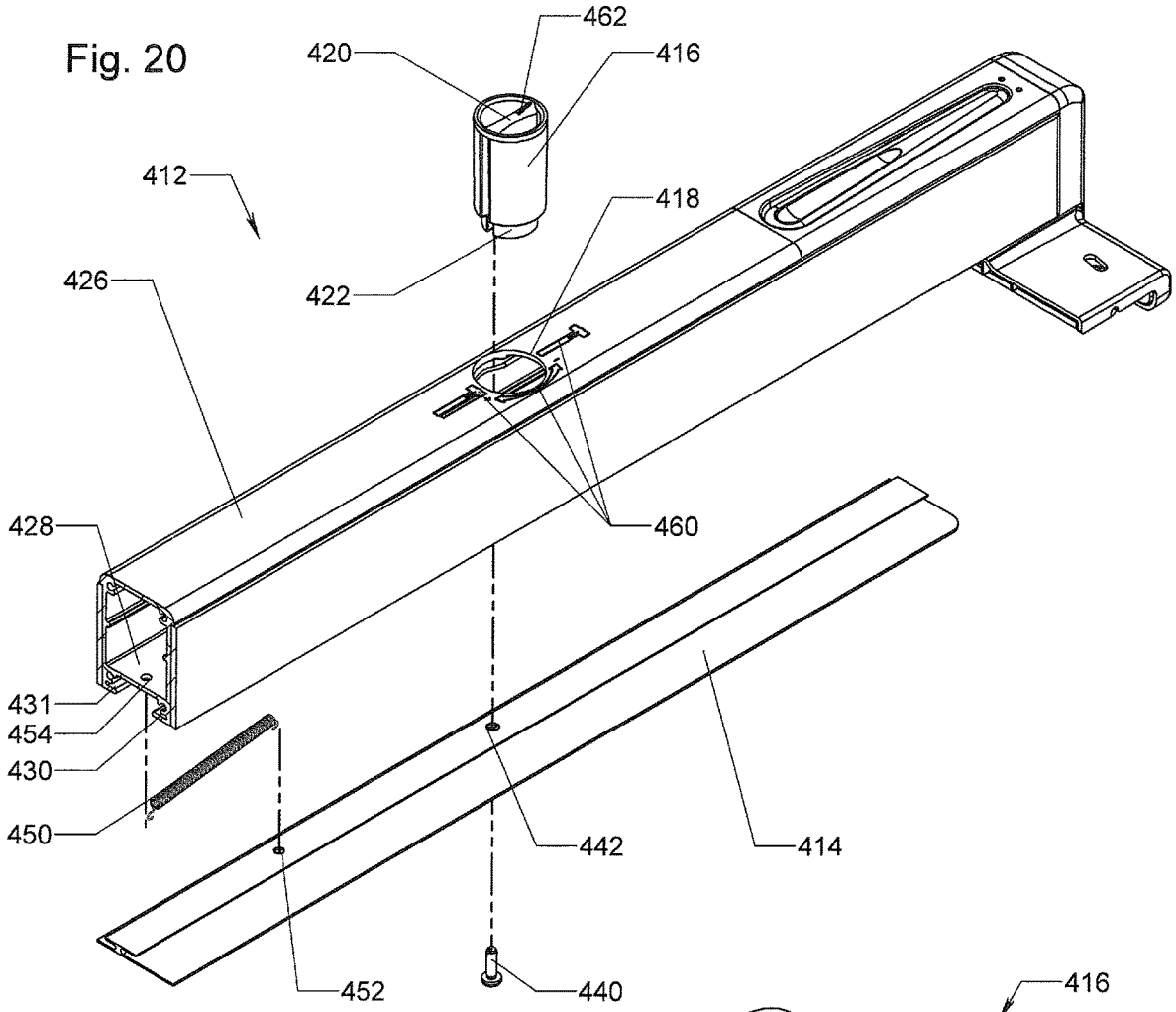
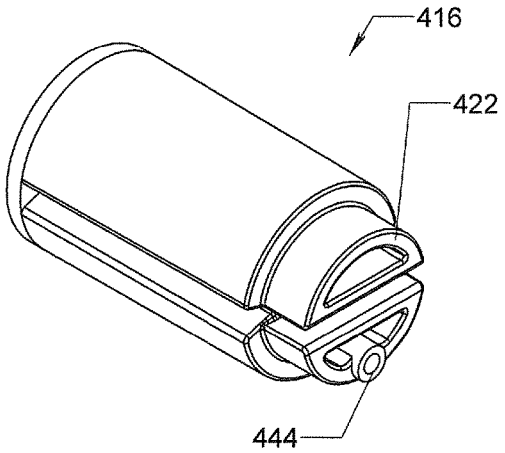
Fig. 21

Fig. 24
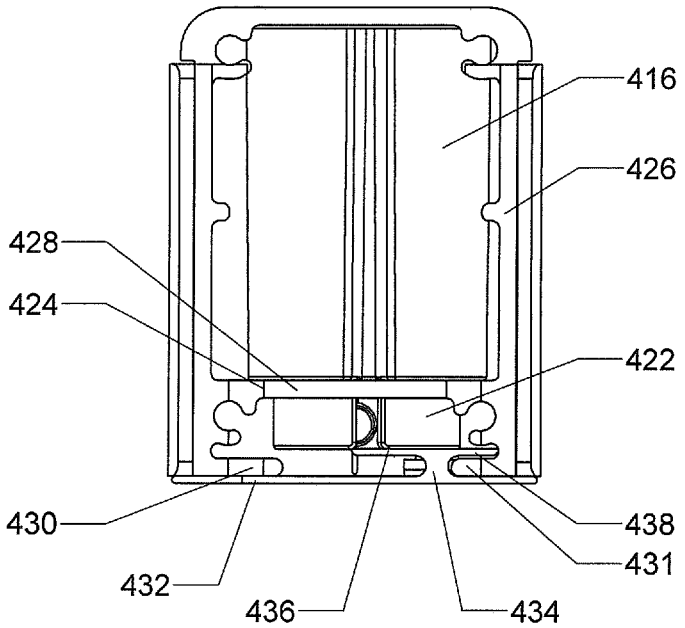
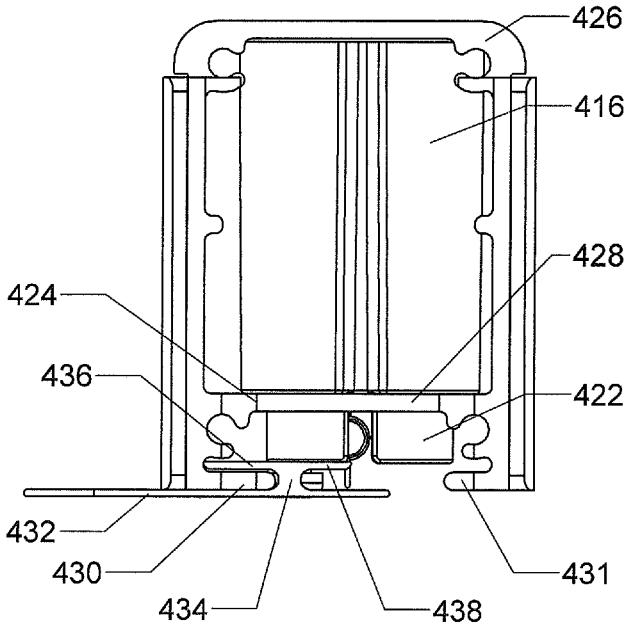
Fig. 25

FENCES FOR TABLE SAWS

CROSS-REFERENCE TO RELATED APPLICATION

This application claims the benefit of and priority from U.S. Provisional Patent Application Ser. No. 62/038,645, filed Aug. 18, 2014, which is incorporated herein by reference.

TECHNICAL FIELD

The present specification relates to fences for table saws. More specifically, this specification relates to fences that are easy to use and ergonomical.

BACKGROUND

A table saw is a power tool used to cut a work piece to a desired size or shape. A table saw includes a work surface or table and a circular blade extending up through the table. A person uses a table saw by placing a work piece on the table and feeding it into contact with the spinning blade to cut the work piece to a desired size. The table saw is one of the most basic machines used in woodworking.

Often a person using a table saw moves a work piece into contact with the spinning blade by sliding the work piece along a guide called a fence. The fence mounts to the top of the table saw and provides a fixed reference surface relative to the blade against and along which the work piece can slide. The fence helps keep the work piece moving in a straight path without shifting or rotating. The fence can be positioned at various positions relative to the blade so that a work piece can be cut to different dimensions.

BRIEF DESCRIPTION OF THE DRAWINGS

FIG. 20 shows an exploded view of the fence of FIGS. 18 and 19 with an end cap removed.

FIG. 21 shows a knob used in the fence of FIGS. 18 and 19.

FIG. 24 shows a cross-sectional view of the fence of FIG. 18 with a shelf retracted.

FIG. 25 shows a cross-sectional view of the fence of FIG. 19 with a shelf extended.

DETAILED DESCRIPTION

Figure 1:
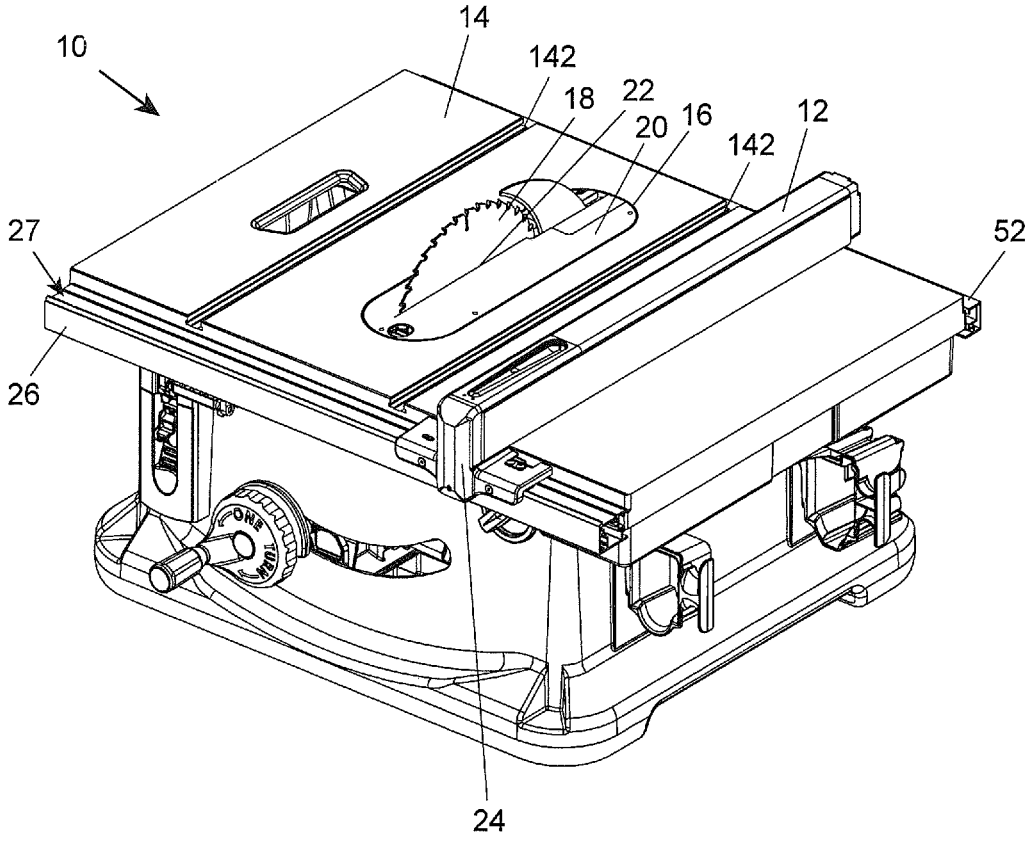
FIG. 1 shows a table saw with a table saw with a fence.

FIG. 1 shows a table saw 10 with a fence 12 installed. The table saw includes a table 14 and the top of the table defines a work surface. Table 14 includes an opening 16, and a blade 18 extends up through the opening 16. An insert 20 is placed in the opening to fit around the blade. The blade extends through a slot 22 in the insert.

Fence 12 is positioned on or over the top surface of table 14 and the fence extends from the front to the rear of the table. Table saw 10 includes a front rail 26 positioned along the front of the saw just below the top of table 14, and fence 12 includes a head portion 24 that extends down to the front rail 26. The fence head 24 may be locked to the front rail 26 to hold the fence securely in place or unlocked to allow the fence to slide along the front rail and table. The fence may be positioned on either side of the blade.

Figure 2:
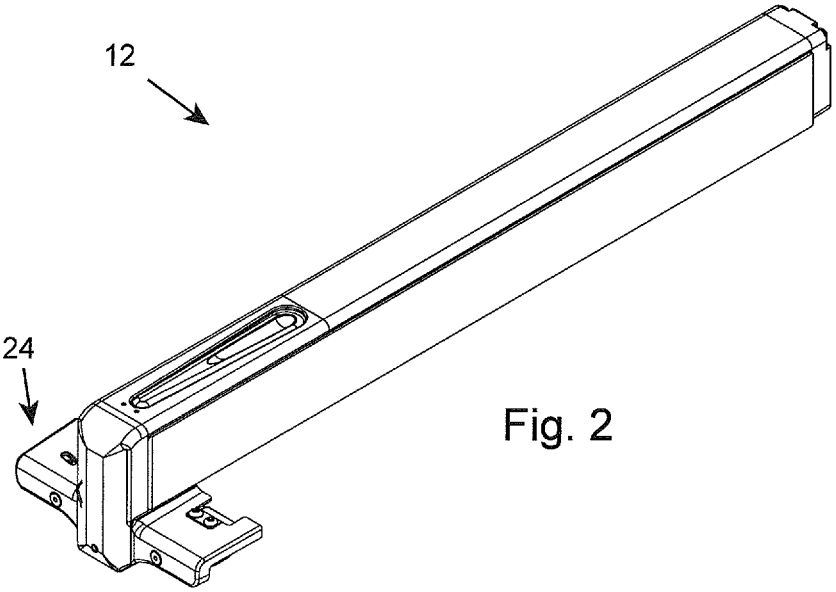
FIG. 2 shows a fence.
Figure 3:
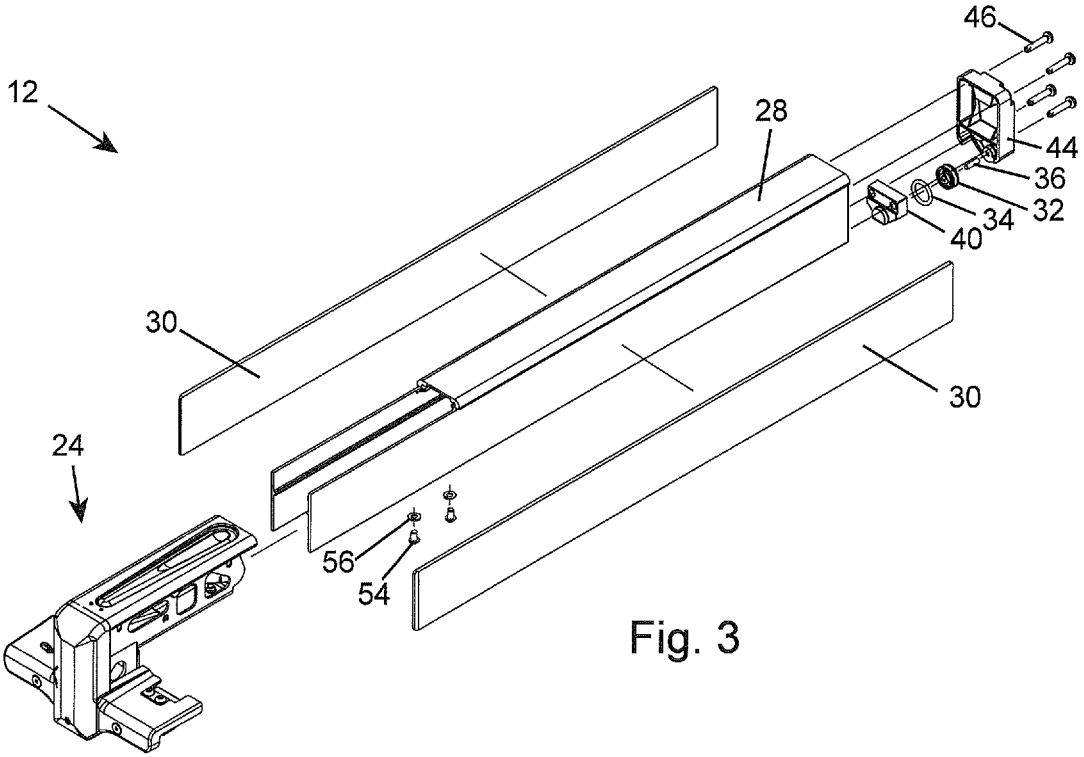
FIG. 3 shows an exploded view of the fence of FIG. 2.

FIG. 2 shows fence 12 isolated and FIG. 3 shows an exploded view of the fence. Fence 12 is composed of a fence head 24 which is attached to a hollow rectangular tube 28. Face plates 30 cover the right and left sides of the tube and provide a flat, smooth surface along which a work piece can slide as the work piece moves past the blade.

At the end of the tube opposite the fence head there is a roller 32 with a rubber insert 34 that fits in a groove along the circumference of the roller 32 and which is secured to the end of the tube 28 by a pin 36 which passes through the center of the roller and is supported at one end in a cylindrical cavity in a roller block 40 and at the other end in a cylindrical cavity in an endcap 44. Endcap 44 is attached to the end of the tube 28 by four screws 46, one located generally at each corner of the endcap, the top two of which thread into holes near the top of the end of the tube and the bottom two pass through holes in roller block 40 and then thread into holes near the bottom of the end of the tube. Roller 32 sits within a large cylindrical shaped cavity in roller block 40 that is open at the bottom to allow the bottom of the roller to extend down below the bottom of tube 28 and roll along a rear rail 52 of the saw to support the distal end of the fence. A user may slide the fence toward or away from the blade on the table to place the fence in a desired position, and roller 32 facilitates the movement of the fence by rolling along the top of the rear rail and by supporting the distal end of the fence. The roller may be positioned to roll along the top of the table instead of along the top of the rear rail, in which case the roller may be larger or a second roller added so that the fence can roll over any slots in the table, such as a slot for a miter gauge.

The end of the fence near the front of the saw may be called a head unit or fence head, as previously mentioned. In the depicted embodiment, fence head 24 is generally shaped like a "T" when looking down at it from above, with the longer middle section of the "T" running along tube 28 and the shorter cross or arms of the "T" running along the front rail 26 of the saw, as shown in FIG. 1. The cross or arms are lower than the middle section of the "T" in order for the arms to rest or ride on the front rail 26, which is below the table top, and the longer middle section is positioned along or slightly above the top of the table.

Fence head 24 attaches to the bottom of tube 28 by two screws 54. Those screws pass through lock washers 56 and then through holes in the bottom of the tube 28 and then thread into holes in the bottom of the fence head.

The components of the fence head 24 and how they fit together are shown in FIGS. 4, 5, 6 and 7. As can be seen in the exploded view of FIG. 4, the fence head 24 has a front cover 60 and a top cover 62. Front cover 60 covers each arm on either side of the middle section of the fence head 24 and also covers the front of the fence head. Two screws 64 pass horizontally through holes 66, one hole through the front of each side arm, and thread into holes 68 in an internal structure 70 to secure the front cover 60 to the internal structure 70. Of course, additional screws and/or clips can be used to secure the front cover to the internal structure. In the depicted embodiment, internal structure 70 is a frame or weldment composed of three pieces welded together, and it provides the basic shape of the fence head. The top cover 62, which has a rectangular shape when viewed from the top, runs along the top of the fence head and has a cutout 72 shaped like a long, narrow oval of a greater radius at the end farthest from the front of the fence. Cutout 72 surrounds the top of a locking lever 74 that allows the user of the saw to clamp and unclamp the fence to the front rail. Top cover 62 has a lip 76 along the front edge that fits under the end of the front cover 60 and also a similar lip along the back edge that fits under the end of the tube 28 so that the pieces mate together without gaps between them.

Figure 4:
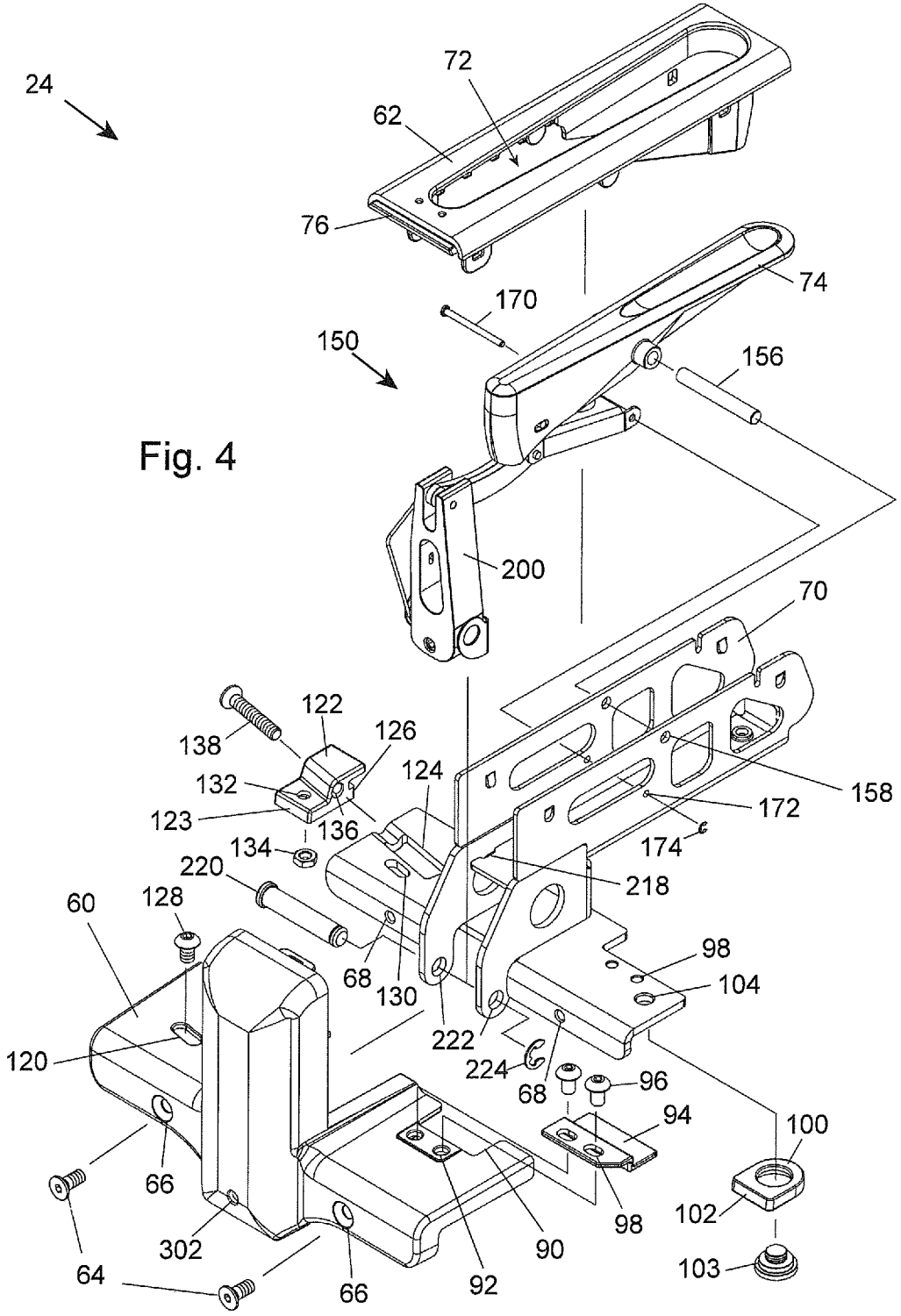
FIG. 4 shows an exploded view of a fence head.

On the right side of the front cover 60, as seen in FIG. 4, there is a rectangular shaped cutout 90 along the rear edge with two holes 92 along the inside edge of the long side of the cutout. A generally rectangular shaped transparent plastic indicator lens 94 is placed under the cutout 90. Lens 94 has a flat raised section running lengthwise that steps down and joins a lower section running lengthwise. The indicator lens 94 attaches to the fence head 24 by two screws 96 which pass through holes 92 on the top of the front cover, then through slightly oval holes 98 in the raised section of the indicator lens, and then thread into two holes 98 in the internal head structure 70. The lens can be used with a ruler on the front rail to measure the position of the fence relative to the blade. A similar lens can be implemented on the other side of the fence head, if desired.

In the depicted embodiment, on the left side of the front cover, there is a slot 120 shaped like a rectangle with the short sides rounded, located on the top of the cover running diagonally such that it moves closer to the front of the front cover while moving inwards towards the middle of the front cover. A slider block 122, that has a rectangular shape looking down from above and a stair-step shape when looking from the side, with the step running along a diagonal line as seen from above, is positioned such that the lower part of the step fits under the internal structure 70 and the upper part sits on top of the internal structure. Internal structure 70 has a diagonal running slot 124, best seen in FIG. 4, for the slider block to fit through. A small ledge 126 extends out from the slider block below the upper step and slips under the internal structure 70. A screw 128 passes through the diagonal slot 120 in the front cover, then through a similar sized and shaped diagonal slot 130 in the internal structure directly below the diagonal slot in the front cover, then through a hole 132 in the lower step of the slider block, and then threads into a nut 134 to secure the slider block to the fence head in such a way that the slider block 122 may be moved along the diagonal slots 120 and 130. There is a threaded hole 136 running through the middle portion of the slider block along and just underneath the surface of the diagonal step into which a screw 138 enters from the outside edge of the fence head. The top of the internal structure 70 dips down under screw 138 to make room for the screw.

The screw 138 allows for adjustment of the fence head with respect to the front rail 26, and thus allows for the adjustment of the fence tube 28 with respect to the table 14 and the blade 18. As the screw is rotated slightly, the slider block is pulled to the left or moved to the right depending on which way the screw is rotated. The surface along the rear of the ledge 126 abuts an edge of the front rail on the saw, and since the screw is at a diagonal, the slider moves along a diagonal as screw 138 turns so that ledge 126 moves closer to or farther away from the front rail on the saw. That causes a slight turning or twisting of the fence in relation to the front rail, which thereby allows the fence to be adjusted so that plates 30 are parallel to the plane of the blade and so that tube 28 is parallel to the miter slots 142 in the table of the saw. When the fence is properly aligned by turning screw 138, the position of slider block 122 can be locked in place by tightening screw 128.

The bottom of slider block 122 contacts the top of front rail 26 to support the fence on the rail. In the depicted embodiment, front rail 26 includes a channel 27 extending along the top of the front rail, and the bottom of slider block 122 fits in the channel. Slider block 122 can be made of plastic to facilitate the fence sliding on the front rail. Slider block 122 also includes a front edge 123 that abuts an edge of channel 27 when the fence is clamped on the front rail. Edge 123 and the corresponding edge of channel 27 can be angled slightly to inhibit the fence from moving up when the fence is clamped to the rail.

A support 100 for the fence is located on the bottom of the right side of the fence head. Support 100 contacts the top of front rail 26, and together with slider block 122, helps support the fence on the rail. Support 100 is shaped to fit within channel 27 on the front rail, and like the slider block, can be made of plastic to facilitate the fence sliding on the rail. Support 100 includes a front edge 102 that abuts the same edge of channel 27 as front edge 123 on slider block 122. Front edge 102 on support 100 can also be angled to correspond to the angle of the edge of channel 27 to inhibit the fence from moving up when the fence is clamped to the rail, similar to front edge 123 on slider block 122. Support 100 is secured to internal head structure 70 by a screw 103 that passes through a hole in support 100 and then threads into hole 104 in internal structure 70.

Figure 6:
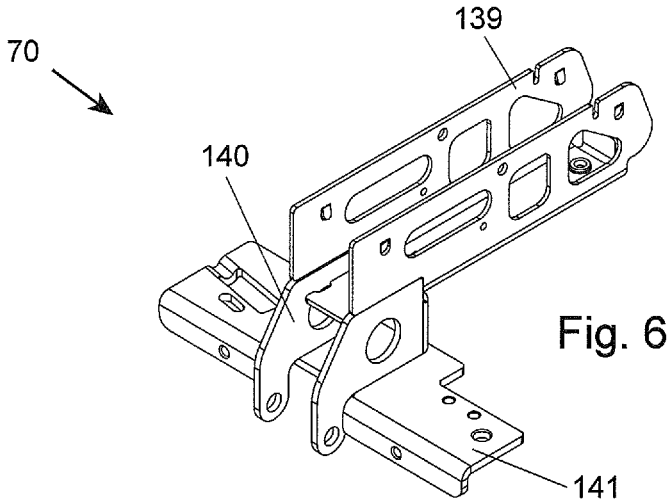
FIG. 6 shows an internal structure used in the fence head of FIG. 4.
Figure 7:
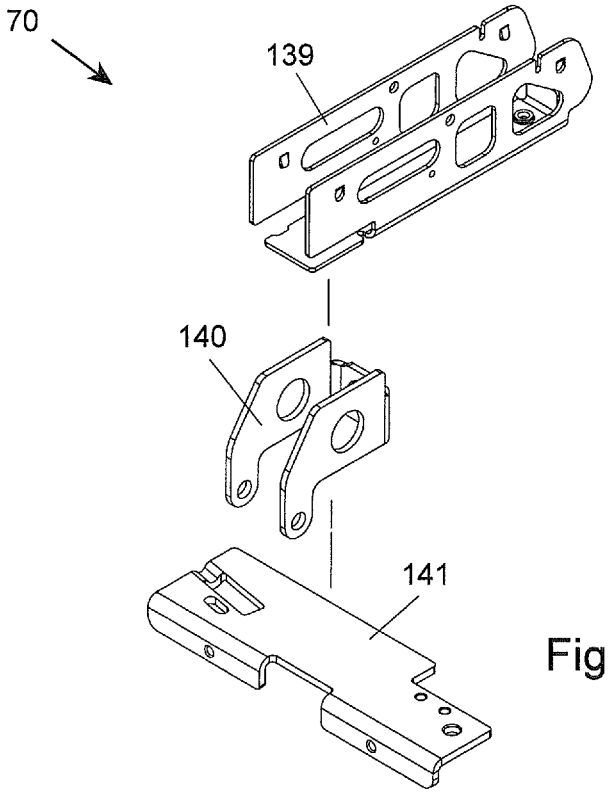
FIG. 7 shows an exploded view of the internal structure of FIG. 6.

Internal structure or frame 70 is shown isolated in FIGS. 6 and 7. As mentioned earlier, it consists of three sections welded together to form the structure of the fence head. There is a rectangular section 139 that has a bottom and two sides but is open on the top and this section runs along and within the front end of tube 28 with the top cover 62 covering the top. A connecting section 140 fits underneath one end of the rectangular section to join the rectangular section to a cross piece 141 that forms the lower arms that ride along the front rail 26. A clamp or locking mechanism 150 fits within the rectangular section and down the front of the internal structure 70 within the sides of the connecting section 140.

Figure 8:
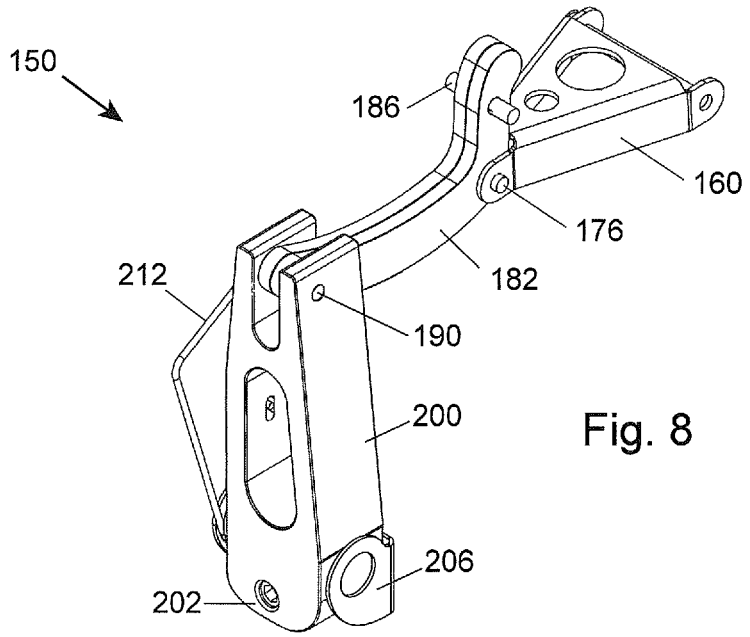
FIG. 8 shows a locking linkage.
Figure 9:
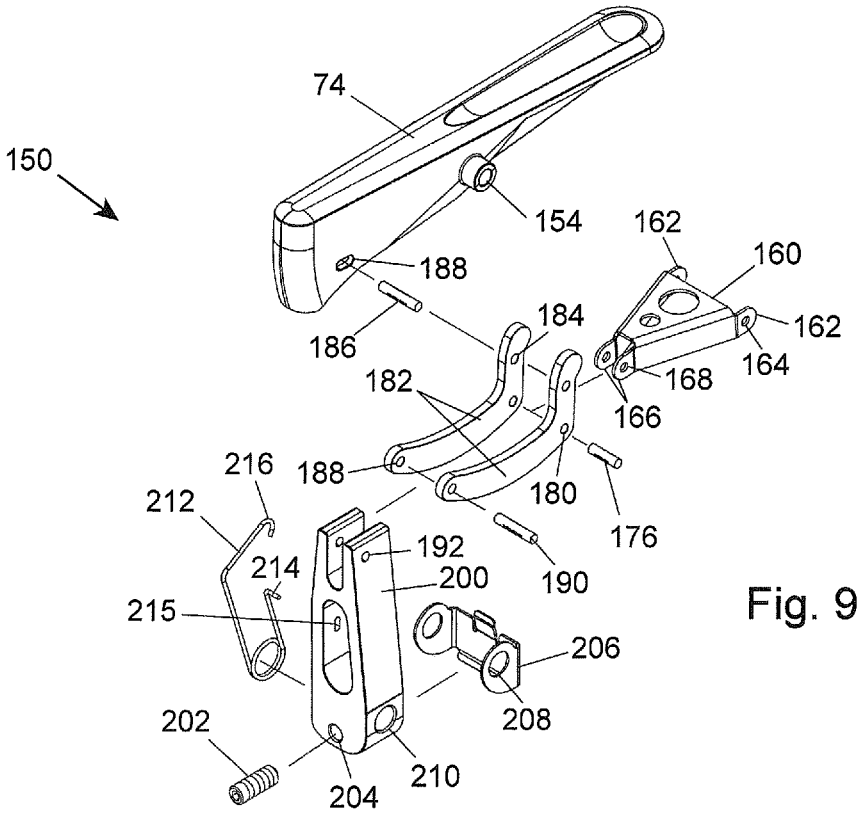
FIG. 9 shows an exploded view of a locking mechanism.

FIG. 8 shows the clamp or locking mechanism 150 isolated (although without locking lever 74, discussed below) and FIG. 9 shows an exploded view of the locking mechanism. The locking mechanism 150 consists of locking lever 74 with cylindrical stubs 154 extending out to each side of the locking lever from the middle. A pin 156 (shown in FIG. 4) fits through the cylindrical stubs 154 and through holes 158 near the top and middle of the internal structure 70 to attach the locking lever to the internal structure in such a way that the locking lever can rotate or pivot around pin 156. The locking lever is shaped so that it can move freely through the cutout 72 in the top cover 62 as the locking lever pivots.

Underneath the locking lever 74 there is a triangular shaped linkage 160 with two extensions 162 off each corner at the base with holes 164 through each extension. There are also two extensions 166 off the corner opposite the base that also have holes 168 through them. A pin 170 (shown in FIG. 4) with a head on one end runs parallel to the base of the triangular linkage 160 passing through the holes 164 in extensions 162 and through holes 172 in the internal structure 70 where it is secured in place with an e-clip 174.

In the depicted embodiment, a short pin 176 runs through one of the holes 168 in one of the extensions 166, then through a hole 180 in each of two flat links 182 that are situated side by side and positioned between extensions 166 on the triangular linkage 160, and then through the other hole 168 in the other triangular linkage extension 166. Each link 182 is a flat metal piece curved gently along one long side until it turns roughly perpendicularly upward at one end. Holes 180 are located in each link 182 approximately at the corner between the gently curved portion and the portion that turns upward, as shown in FIG. 9. Pin 176 pivotally attaches the triangular linkage 160 to the flat links 182, as shown. At the upward turning end of each flat link there is another hole 184, and a pin 186 passes through both holes 184. The ends of pin 186 extend out from the flat links and fit in a small oval slot 188 at the base of the front of the locking lever 74 so that the flat links pivot around pin 186 as the locking lever pivots. At the other end of each flat link 180 there is another hole 188 through which passes another pin 190, and each end of pin 190 fits into a hole 192 on either side of a locking block 200.

Figure 5:
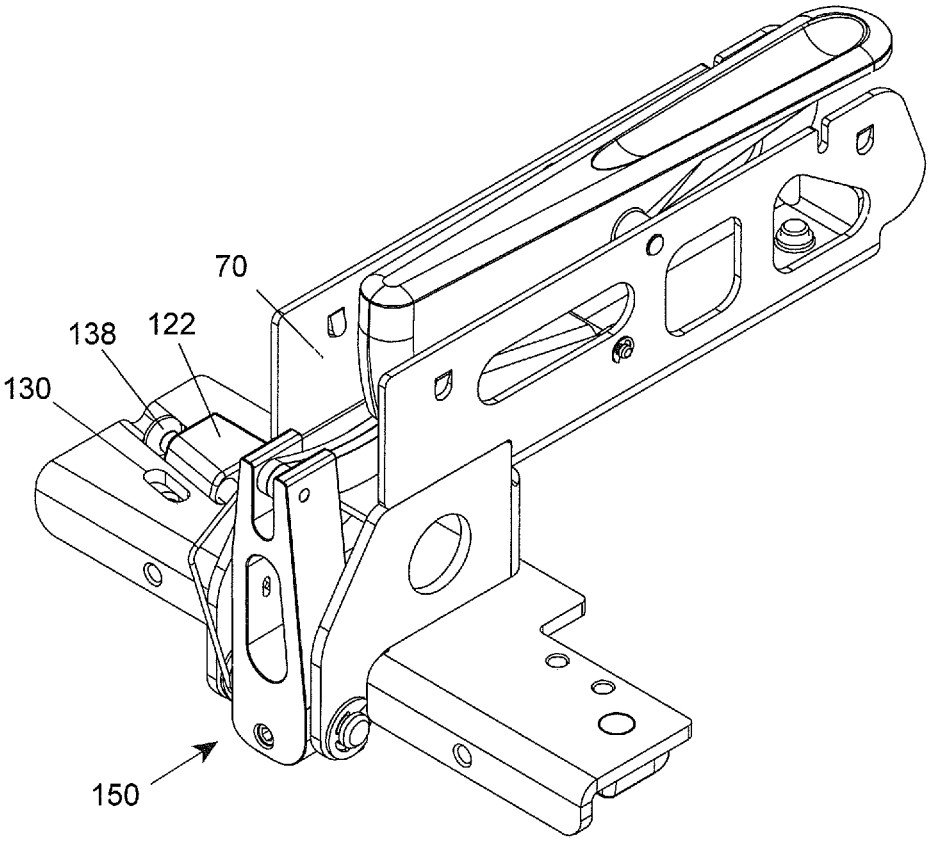
FIG. 5 shows a view of parts used in the fence head of FIG. 4.

Locking block 200 extends up along the outside of the flat linkages 182, as shown in FIG. 8, and then down so that the bottom portion of the locking block is positioned in front of the front rail 26. A set screw 202 threads into a hole 204 at the bottom of the locking block and can be rotated to move the bottom portion of the locking block closer to or farther from the front rail. A locking plate 206, shaped like a short, flat plate bent approximately ninety degrees on both sides, has holes 208 through each side. Locking plate 206 fits over the lower portion of the locking block 200 and holes 208 align with a hole 210 in the locking block. A spring 212 lies along the left side of the locking block and is shaped like a loop with each end continuing out from the loop in a straight line parallel to each other until end 214 bends approximately ninety degrees to fit into a small hole 215 in the side of the locking block 200, and the other end, which is to the front of the locking block, bending a little less than ninety degree back toward end 214, continuing straight for about half the length of the straight segment exiting the loop, and then curling to form a hook 216 which fits into a small slot 218 (labeled in FIG. 4) along the left bottom edge of the internal structure 70 near the front of the rectangular section of the weldment. A pin 220 with a head on one end passes through a hole 222 at the bottom of the internal structure 70, then through a loop at the bottom of spring 212, then through one of the holes 208 in the locking plate 206, then through hole 210 in the locking block 200, then through the other hole 208 in the locking plate, and finally through another hole 222 in the internal structure 70. Pin 220 is secured in place by an e-clip 224, as shown in FIGS. 4 and 5.

Figure 10:
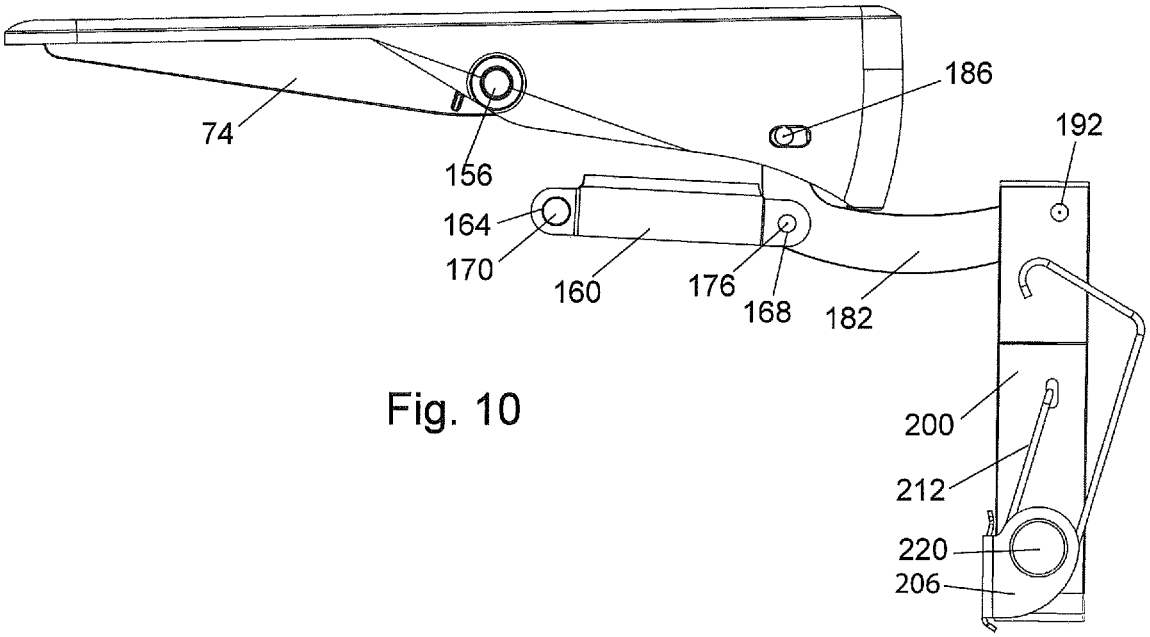
FIG. 10 shows a locking mechanism in a locked, clamped or closed position.
Figure 11:
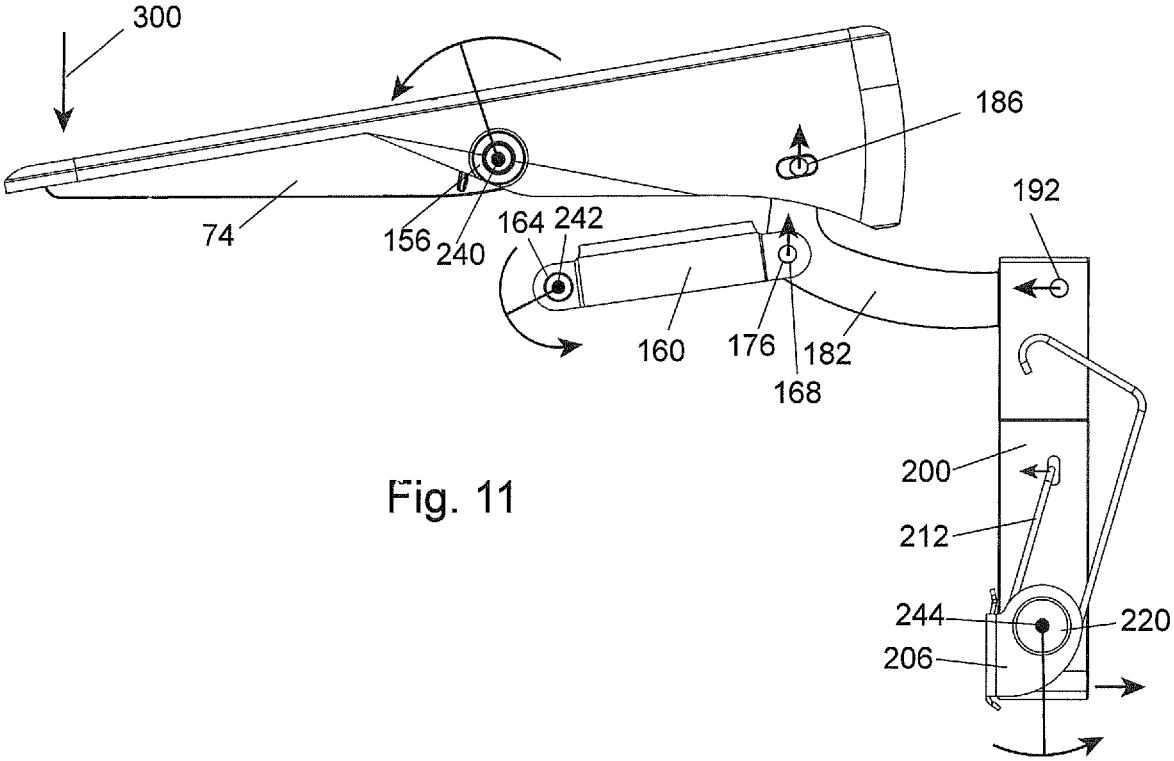
FIG. 11 shows a locking mechanism is an unlocked, unclamped or open position.

Clamp or locking mechanism 150 enables the fence to be securely clamped or locked to the front rail when the locking lever is in a horizontal position as shown in FIG. 10. In this locked configuration, holes 164 in the triangular linkage are generally along the same horizontal line as holes 192 in the locking block 200, while hole 168 in the triangular linkage is at or slightly below that line so that the top of the locking block is pushed outward and the bottom of the locking block, which pivots around pin 220, is pushed up against the front rail to clamp the fence to the front rail. To unlock the fence, the end of the locking lever 74 farthest from the front of the fence is pushed downward, as shown by arrow 300 in FIG. 11, thus raising pin 186, which pulls pin 176 upward and out of alignment with holes 164 in the triangular linkage and holes 192 in the locking block 200. That, in turn, draws the top of the locking block inward, and thus the bottom of the locking block is pushed outward away from the front rail to unclamp the fence head from the front rail. In FIG. 11, for clarity, the pivot points that are rigidly held in place by the internal structure 70 are shown with dots at 240, 242, and 244, and arrows near those locations indicate movement or pivots.

In use, fence 12 is placed on a saw, over the tabletop, with tube 28 extending from the front of the saw to the rear. The fence is supported at the front by slider block 122 and support 100 resting on front rail 26, and at the back by roller 32 and rubber insert 34 resting on rear rail 52. When the fence is placed on the saw, clamp or locking mechanism 150 is open, as shown in FIG. 11, with the bottom of locking block 200 extending out, away from the front of the saw so that fence head 24 can fit over the front rail. Also, with locking mechanism 150 open, slider block 122 and support 100 can be positioned or placed in channel 27 in the front rail.

A user then grasps the fence by hand adjacent locking lever 74, and slides the fence to the right or left until it is located at a desired position relative to blade 18. Grasping the fence over the locking lever is between the ends of the fence and near the center of gravity of the fence because the head portion has more mass than the fence tube, and as a result, grasping the fence over the locking lever reduces the tendency of the fence to twist or rotate when a user slides the fence into position. In other fences, a user grasps a handle extending out from the proximate end of the fence (i.e., the end nearest the front of the saw), and when the user applies a force to the handle to slide the fence into position, the distal end of the fence (i.e., the end furthest from the front of the saw) lags behind resulting is a jittering or rough motion rather than a smooth translational motion.

With locking mechanism 150 open, the proximate end of locking lever 74 (i.e., the end nearest the front of the saw) extends up above the top surface of tube 28, as shown generally in FIG. 11. When the fence is positioned as desired, the user locks or clamps the fence in place by simply pushing the locking lever down with the heel or palm of their hand. The user's hand is already over the locking lever because that is the natural position to grasp and move the fence, so depressing the locking lever with the heel or palm of the hand is a natural and simple movement and does not require the hand to be repositioned. Once the proximate end of locking lever 74 is depressed a small amount, the linkage connecting the locking lever to locking block 200 goes over-center (i.e., holes 168 move below the line defined by holes 164 in triangular shaped linkage 160 and holes 192 in the locking block) and clamps or locks the fence in place. Once closed, the linkage is stable and will not open until the locking lever pivots. In some embodiments, a spring could be used to bias the locking mechanism closed.

To unclamp or unlock the fence, a user simply presses or pushes down with a finger on the distal end of locking lever 74 (i.e., the end furthest from the front of the saw). Pushing down on the distal end of locking lever 74 moves the bottom of locking block 200 away from the front rail, as explained, to open the clamp. The locking mechanism is also stable in this open position because holes 168 move over-center. Accordingly, locking mechanism 150 may be thought of as being bi-stable, i.e., stable in both an open and closed position and configured so that the locking mechanism goes to either an open or closed position.

Spring 212 is configured to bias the locking mechanism open, so when the distal end of locking lever 74 pivots down enough to move holes 168 over-center, i.e., above the line between holes 164 and 192 (as seen in FIGS. 10 and 11), spring 212 helps open the clamp and holds the locking mechanism open. When a user pushes down on the distal end of locking lever 74, the user's hand is already over the fence so the user can simply grasp the fence and slide it to a desired position. The user can then simply bump the proximal end of the locking lever down with the heel of the user's hand to clamp the fence in place.

A locking mechanism as described herein can also be configured so that it automatically locks or clamps the fence to the saw when a user is not touching the locking lever. This may be thought of as an auto-lock feature because the fence automatically locks in place when a user releases or moves their hand away from the fence. Additionally, a locking mechanism can be configured to open when a user pivots a locking lever a first distance, and to close automatically when the user releases the locking lever, but the locking mechanism will stay open if the user pivots the locking lever a second distance greater than the first distance. With this configuration, a user can selectively open the locking mechanism and know that the fence will lock in place when the user removes their hand from the fence, or the user can open the locking mechanism and have it remain open when the user removes their hand from the fence. This latter situation would be useful if, for example, the user wanted to remove the fence from the saw.

The fences described herein are ergonomic and easy to use. A user can position the fence on the saw and then lock the fence in position without having to reposition their hand on the fence and without having to grasp a separate handle. In the depicted embodiment, this is due at least in part to the fact that the locking lever is positioned substantially or wholly between the ends of the elongate portion of the fence, and/or substantially above the saw table, and/or within the perimeter of the table (where the perimeter includes any rail or rails attached to the table), and/or at a location where it is natural to grasp the fence.

Providing a fence with a locking lever as described herein also promotes usability of the fence because the locking lever does not extend substantially above the top of tube 28 when the locking mechanism is closed or clamped, as seen generally in FIGS. 1 and 10. This allows a user to slide their hand along the top of the fence when guiding a work piece past the blade. Some woodworkers use their right hand to help hold a work piece in position against the fence as they push the work piece into contact with the blade, and they do this by placing part of their hand over the top of the fence while simultaneously holding the work piece against the fence. They then slide their right hand along the top of the fence to maintain the position of the work piece relative to the fence as they make the cut. Leaving the top of the fence unencumbered allows the hand to slide along the top of the fence. Additionally, having at least a portion of the locking lever extend up above the top of the fence or tube 28 when the locking mechanism is open or unlocked provides a visual and tactile indication to a user that the fence is not locked in position, and therefore the fence can move relative to the table. Similarly, in the embodiment described above, a portion of the locking lever is recessed or pressed down below the top of the fence tube, and that provides an additional visual and tactile indication that the fence is not locked in position.

Providing a fence with a locking lever at least partially above the table decreases the perimeter of the saw and therefore increases the clearance, maneuverability, storability and usability of the saw. With the locking lever positioned at least partially above the table, the need to watch out for a handle sticking out from the front of the saw when moving or storing the saw is eliminated, thereby making it is easier to move the saw through doorways and other tight places, and making it is easier to store the saw or place the saw in the back of a truck. The fence handle simply does not stick out from the saw, and therefore, the saw is easier to move around. Additionally, a user can stand closer to the front edge of the table saw because there is no fence handle to block the user from doing so, and standing closer to the front edge of the table saw makes it easier to control the movement of the work piece past the blade.

With a fence as described herein, the perpendicularity of the fence relative to the front of the table saw, and the parallelism between the face plates on the fence and the blade, are easy to adjust, as explained. Moving slider block 122 to the right or left adjusts the perpendicularity of the fence and aligns face plates 30 with the blade. After slider block 122 is moved, it may be necessary to adjust the position of locking block 200 to insure the locking block provides an appropriate or desired clamping pressure on the front rail. This is accomplished by turning screw 202, as explained. Front cover 60 includes a hole 302, shown in FIG. 4, to provide access to screw 202.

Figure 12:
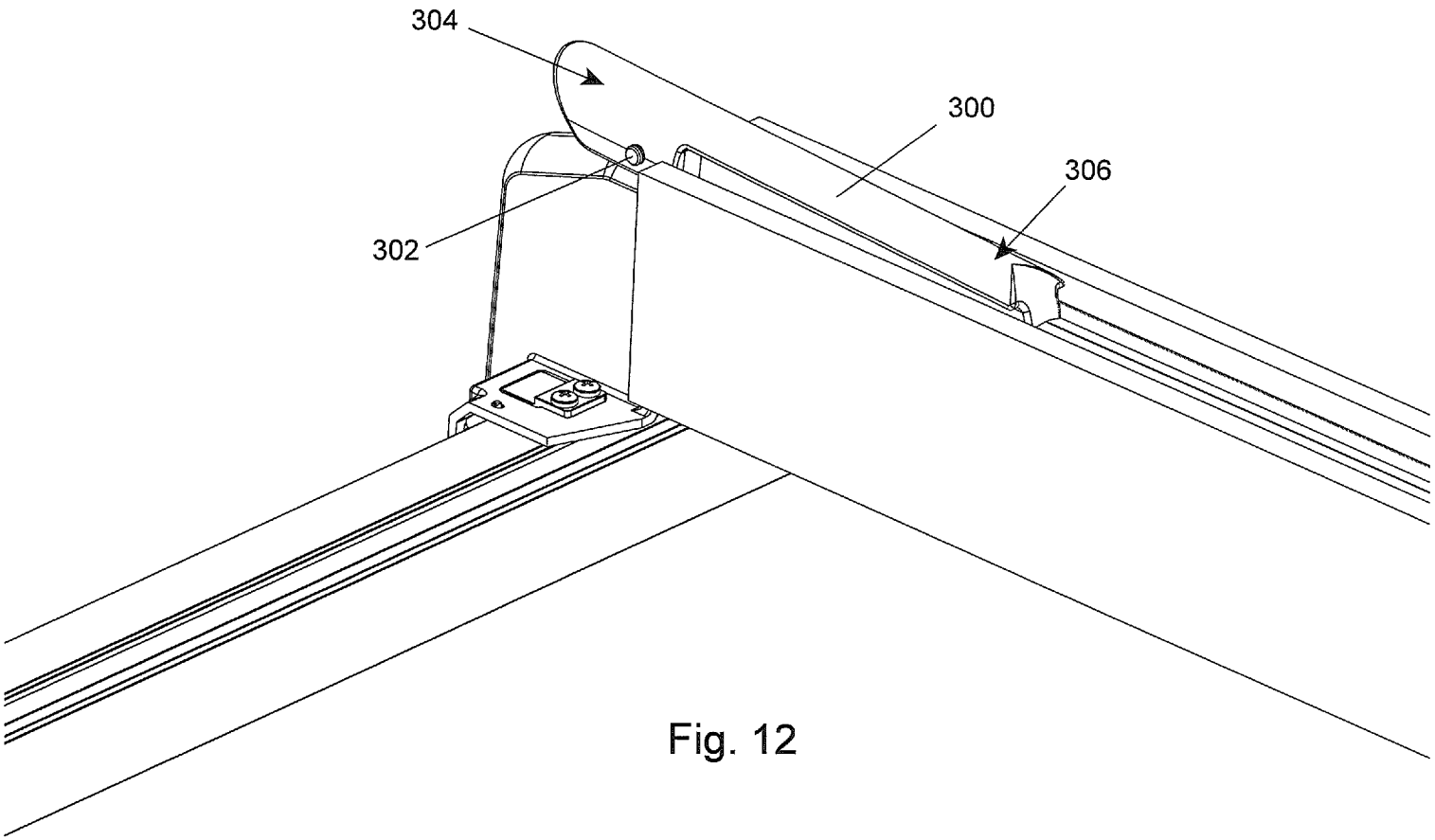
FIG. 12 shows an embodiment of a fence with a rocker that pivots around a pin.

FIG. 12 shows an embodiment of a fence with a rocker 300 that pivots around a pin 302. In this embodiment, a user can depress the proximate end 304 of the rocker to release or unclamp the fence and cause the distal end 306 to pop up. A user could press distal end 306 to lock or clamp the fence in position. In FIG. 12, rocker 300 is shown in the locked or clamped position.

Figure 13:
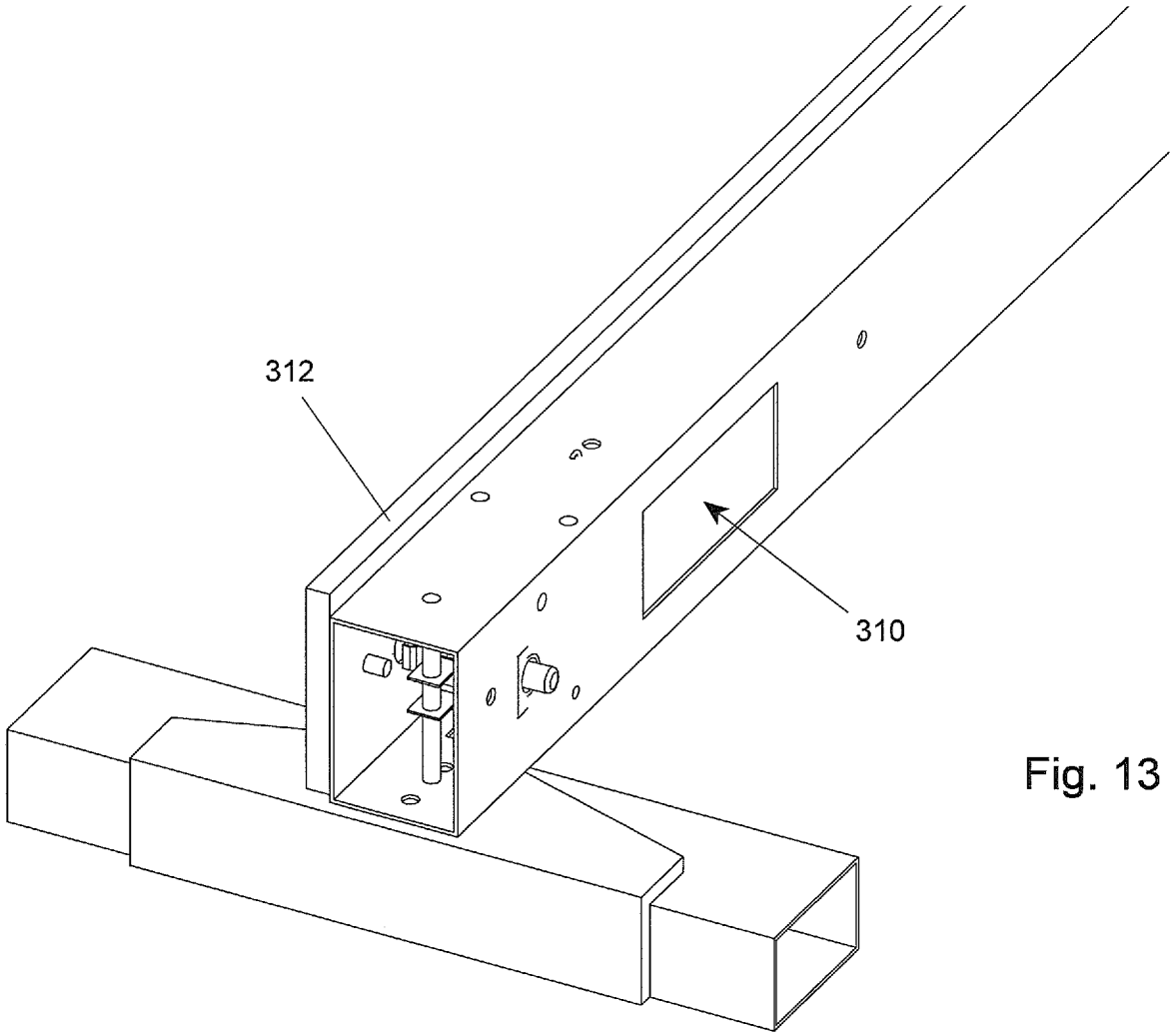
FIG. 13 shows an embodiment of a fence with a side actuator.

FIG. 13 shows an embodiment of a fence with a side actuator 310 on the right side of the fence tube. In this embodiment, a user squeezes side actuator 310 to release or unlock the fence, and continues to squeeze the actuator while sliding the fence into position. When the user releases the actuator, the fence auto-locks in position. This embodiment includes a removable face plate 312 that can be attached to the opposite side of the fence so that the fence can be used on the left side of the blade. A second side actuator is located on the left side of the fence tube opposite actuator 310 for this situation, and the second side actuator functions the same as actuator 310.

Figure 14:
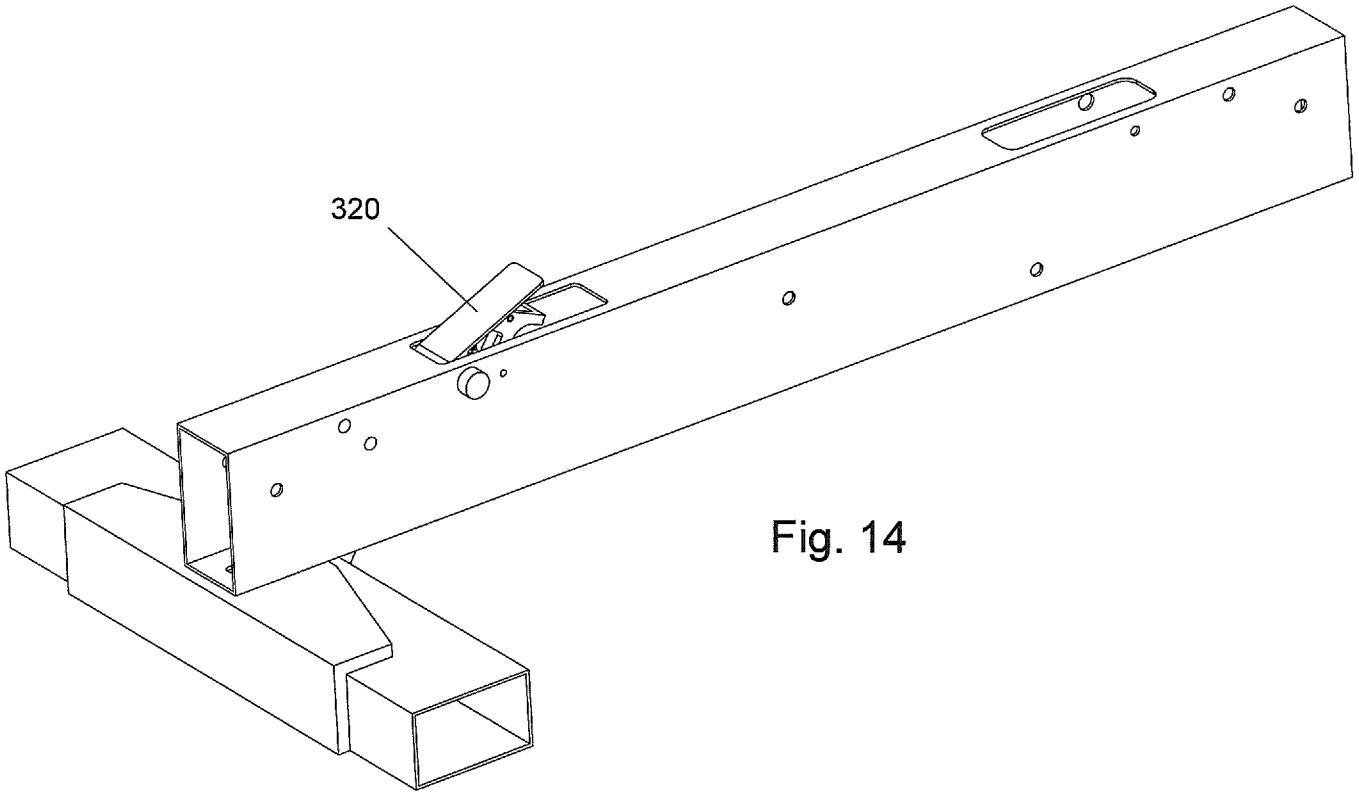
FIG. 14 shows an embodiment of a fence with a finger-pull actuator.

FIG. 14 shows an embodiment of a fence with a finger-pull actuator 320. In this embodiment, the fence is unclamped and free to move when a user pulls actuator 320 up, and the fence auto-locks in position when actuator 320 is released. Actuator 320 can be configured so that it is substantially flush with or below the top of the fence when the actuator is released, or at least not significantly above the top of the fence.

Figure 15:
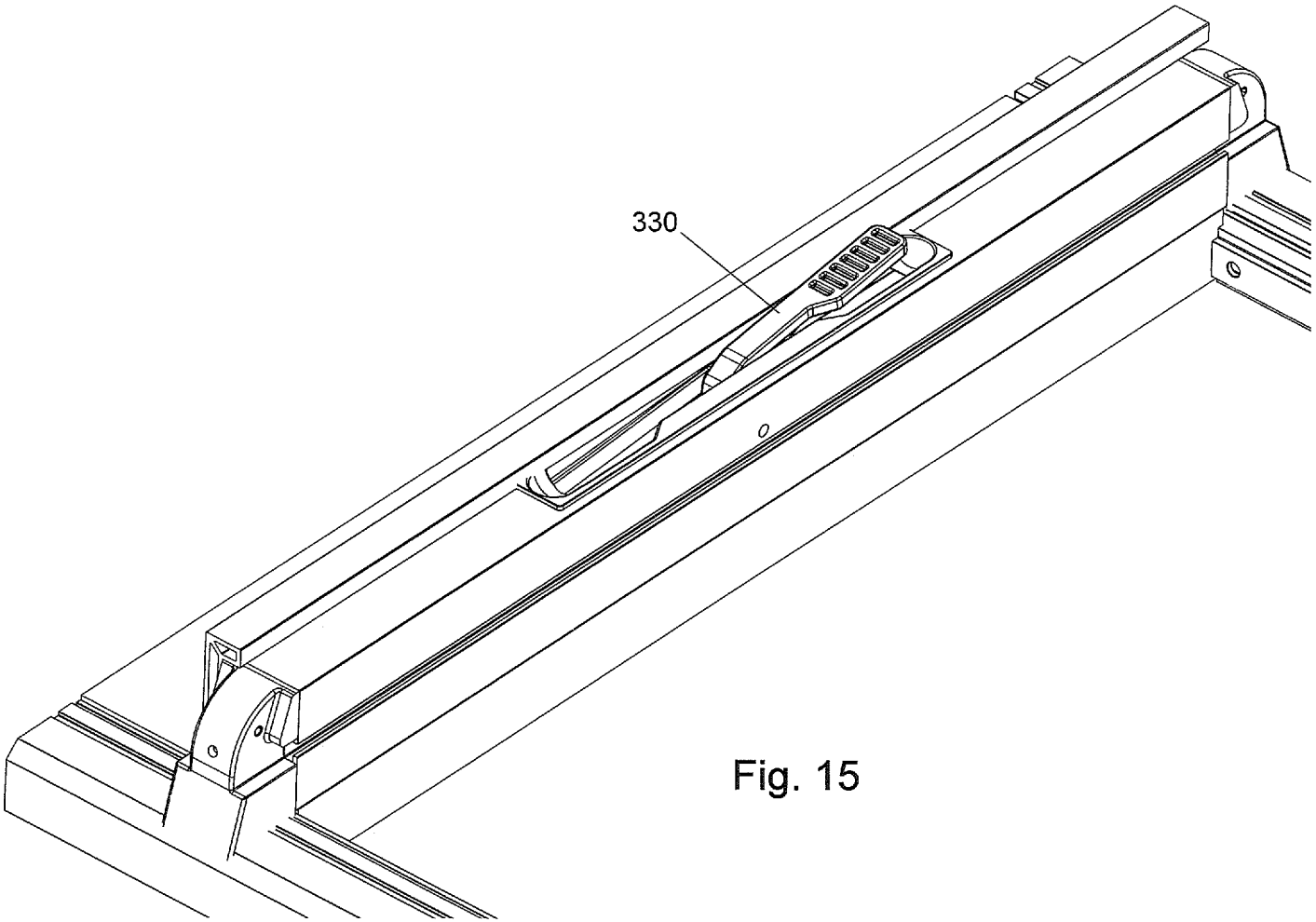
FIG. 15 shows an embodiment of a fence with a lever that can pivot both forward and backward to lock the fence in position.

FIG. 15 shows an embodiment of a fence with a lever 330 that can pivot both forward and backward to lock the fence in position. The fence is unlocked when lever 330 extends roughly straight up, and is locked when lever 330 pivots to the front or back. Lever 330 is shown pivoted to the back in FIG. 15. This type of lever is particularly useful for fences that are reversible, or in other words, fences with a non-removable face plate and a fence head at each end and so that the fence is flipped around (i.e., turned 180 degrees) when used on the left side of the blade.

The length of the rail along the front of the saw determines how far the fence can be positioned from the blade, and therefore, the largest dimension that can be cut on the saw using the fence. This may be called the cutting capacity or rip capacity of the saw. Some table saws include rails sufficiently long to provide 36 inches of cutting capacity—in other words, the face of the fence nearest the blade can be positioned 36 inches away from the blade so a work piece can be cut to 36 inches wide, and the front and rear rails are long enough to support the fence in that position. Other table saws include rails with 52 inches of cutting capacity. Saws with these cutting capacities are typically stationary saws called cabinet saws or contractor saws. Smaller, portable table saws, such as jobsite or bench-top saws, typically provide anywhere from 18 inches to about 30 inches of cutting capacity.

Figure 16:
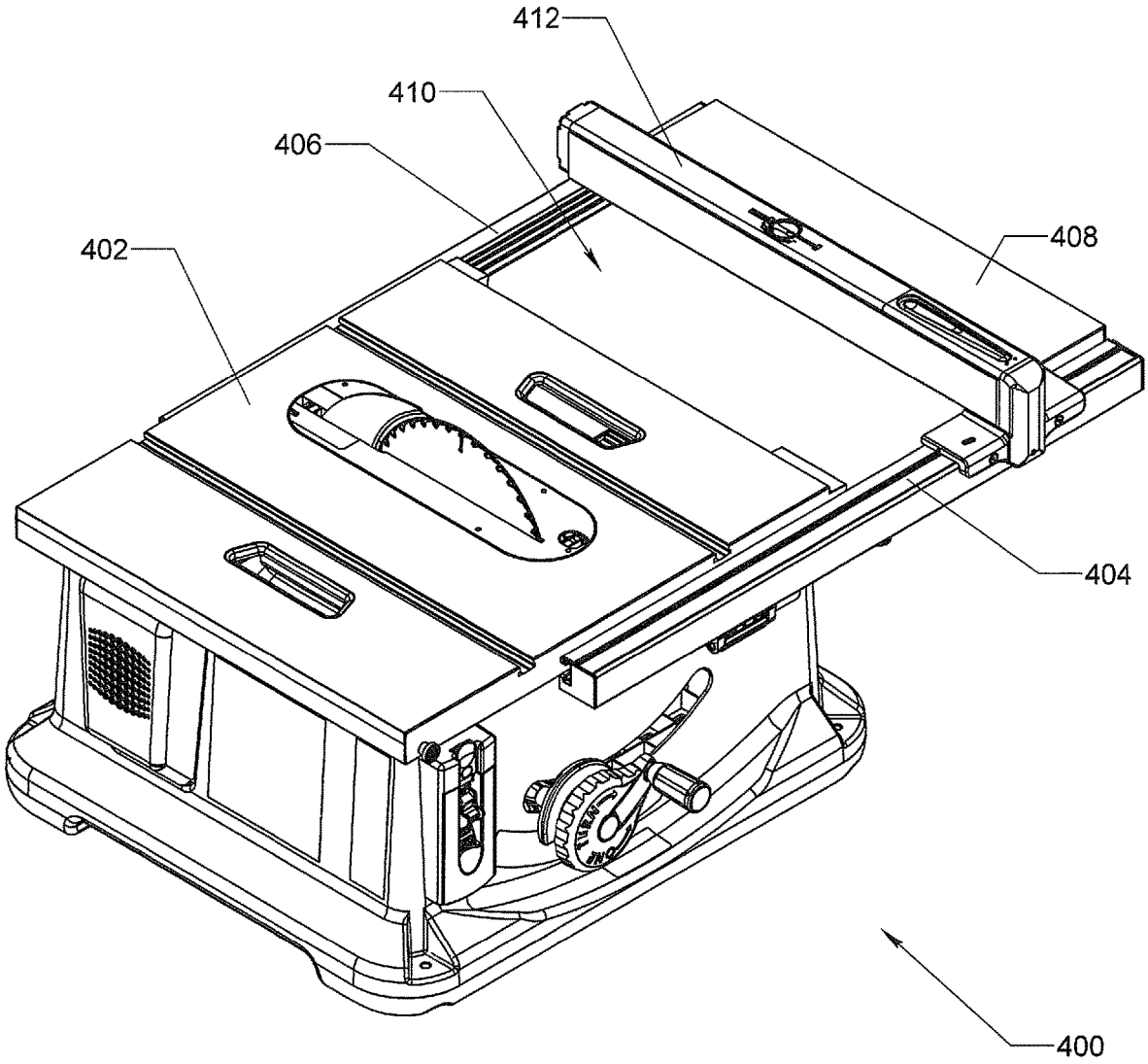
FIG. 16 shows a table saw with a fence.

In smaller, portable table saws, the rails may move or telescope out to provide increased cutting capacity. FIG. 16 shows a portable table saw 400 with a table 402 and front and rear rails 404 and 406, respectively, attached to the table in such a way that they can move to the right to provide increased cutting capacity. An extension table 408 extends between the right, distal ends of the front and rear rails and is connected to both rails. The extension table provides an additional support surface for work pieces, especially when the rails are extended. When the rails are extended in such a saw, there is an opening 410 between the main table and the extension table. If the fence is positioned over opening 410, as shown in FIG. 16, there is no table under the fence to support the work piece. In that situation, a thin work piece, such as a piece of veneer or laminate, may sag below the bottom of the fence, or even a thicker work piece may naturally curve below the bottom of the fence or below the plane of the table top, which then makes it difficult to slide the work piece along and against the fence.

Figure 17:
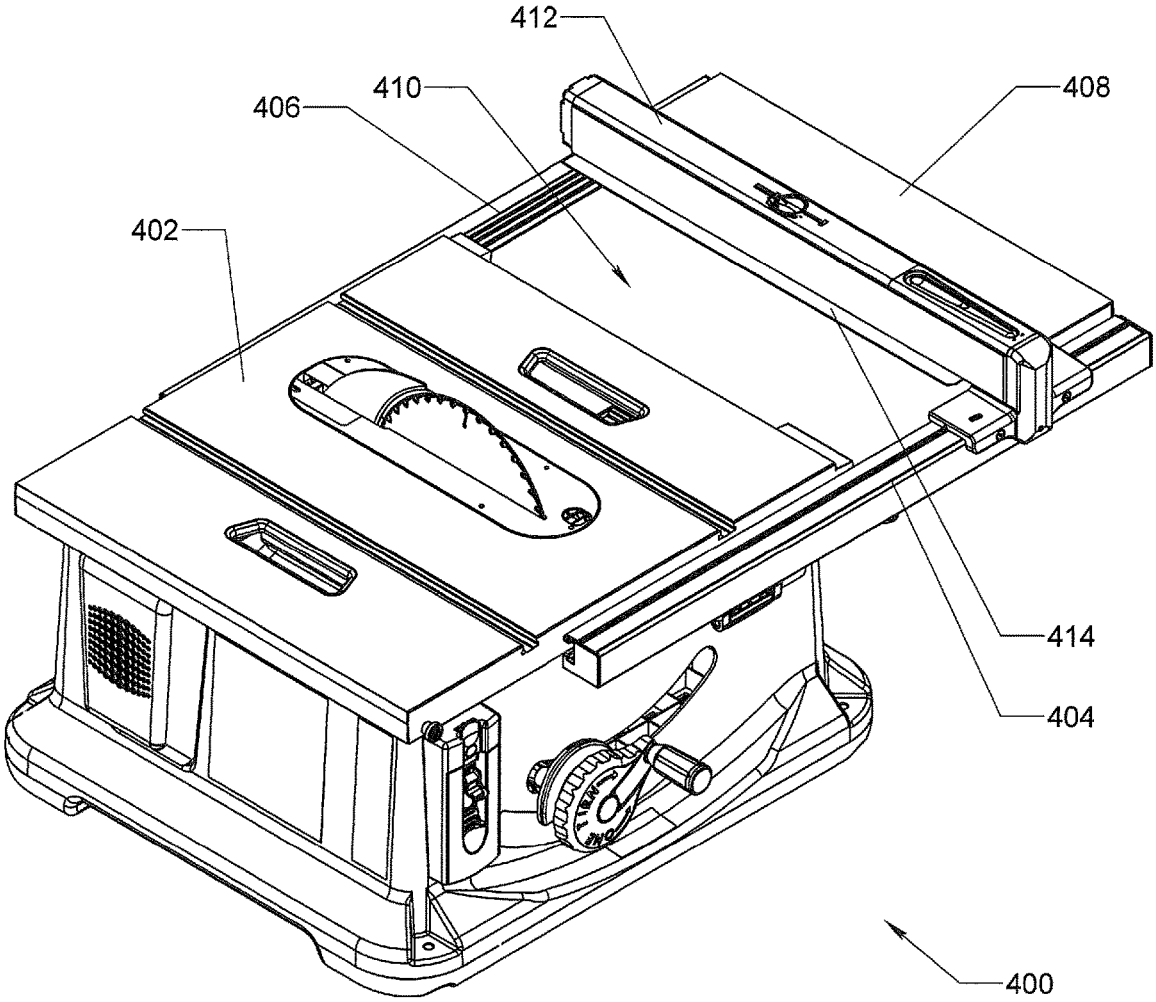
FIG. 17 shows a table saw with a fence having a support shelf extended.

To address this issue, a fence, such as fence 412 in FIGS. 16 and 17, may be equipped with a support of some kind to hold up or support a work piece against the fence. In the embodiment depicted in FIG. 17, the material support is a shelf 414 configured to extend out from fence 412 when needed to support a work piece, and to retract below or into the fence when not needed.

Figure 18:
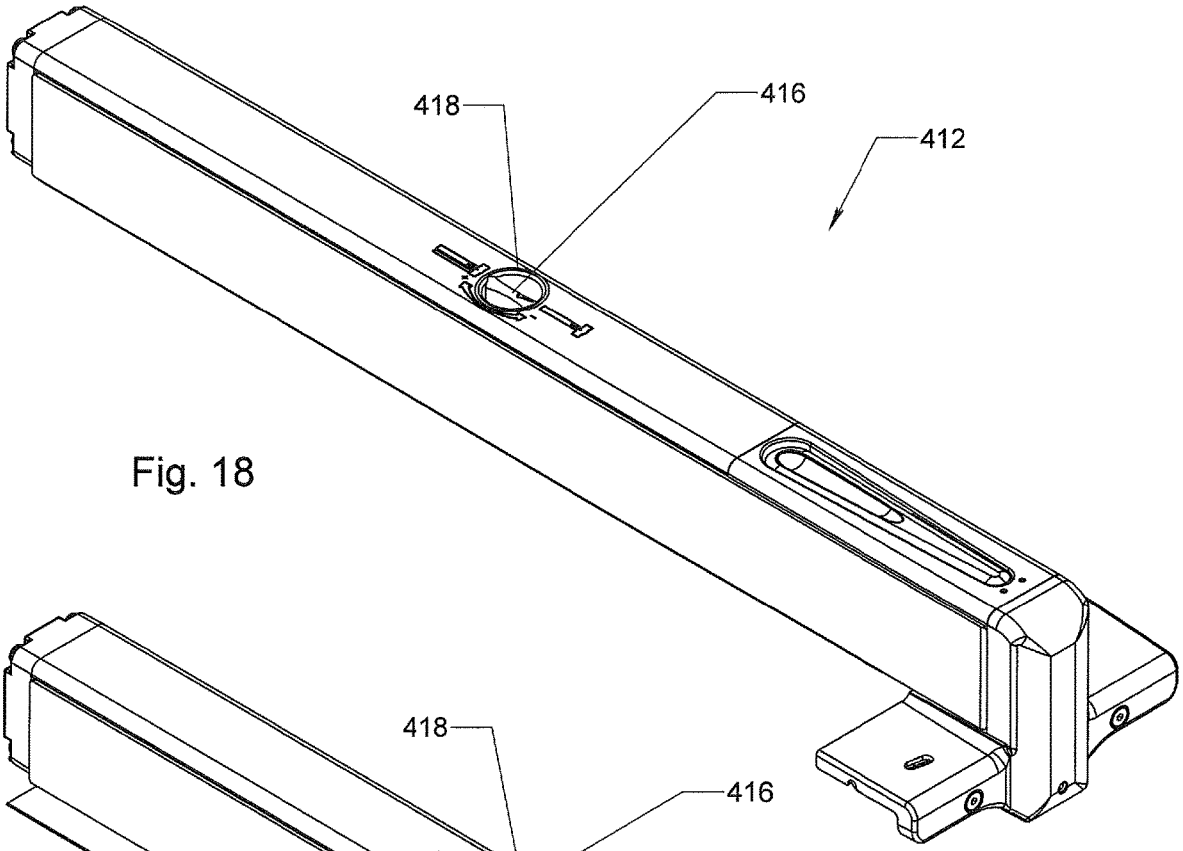
FIG. 18 shows a fence.
Figure 19:
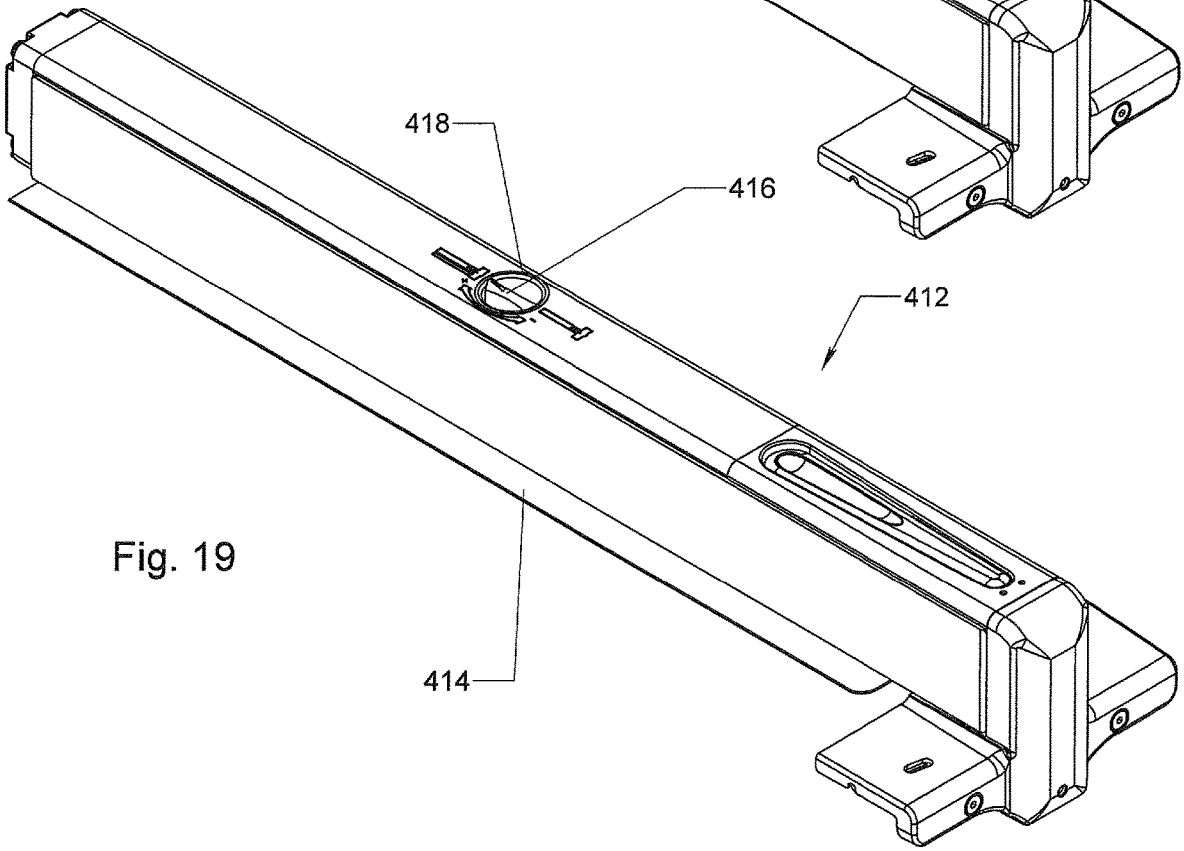
FIG. 19 shows the fence of FIG. 18 with a support shelf extended.

Fence 412 is shown isolated from other structure in FIGS. 18 and 19. In FIG. 18, shelf or support 414 is retracted, while in FIG. 19 it is extended. Fence 412 includes a knob 416 that is configured so that a user can grasp the knob by hand and rotate or turn it in one direction to extend shelf 414 (e.g., clockwise) and in the opposite direction to retract the shelf (e.g., counterclockwise). In the depicted embodiment, knob 416 is positioned in a hole or socket 418 in the top of the fence so that the top of the knob is below the top of the fence. This allows a user to slide a hand along the top of the fence without bumping the knob or being otherwise obstructed while guiding a work piece into contact with the saw blade.

Knob 416 is generally cylindrical, as shown in FIGS. 20 and 21, with a largely hollow center and a web 420 spanning from one side to the other of the hollow center. The hollow center allows a user to grasp web 420 and turn the knob. Of course, knob 416 may take other configurations, including configurations that extend above the top of the fence.

In the depicted embodiment, the bottom end of knob 416 includes a cylindrical projection 422 with a smaller diameter than the main body of knob 416. Projection 422 is configured to extend through a circular hole or opening 424 in the bottom of the fence, as shown in FIGS. 24 and 25. Fence 412 includes a main tube 426 with a bottom wall 428, as shown in FIG. 20, and hole 424 provides an opening through bottom wall 428 so that projection 422 can extend through the hole with the main body of knob 416 resting on the bottom wall.

Figure 22:
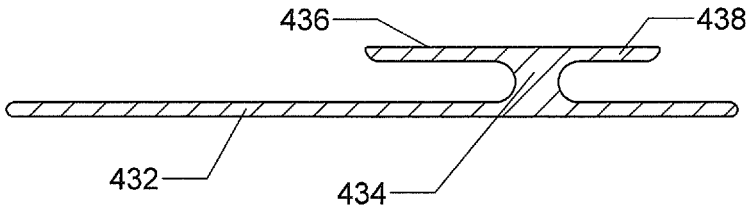
FIG. 22 shows a shelf used in the fence of FIGS. 18 and 19.
Figure 23:
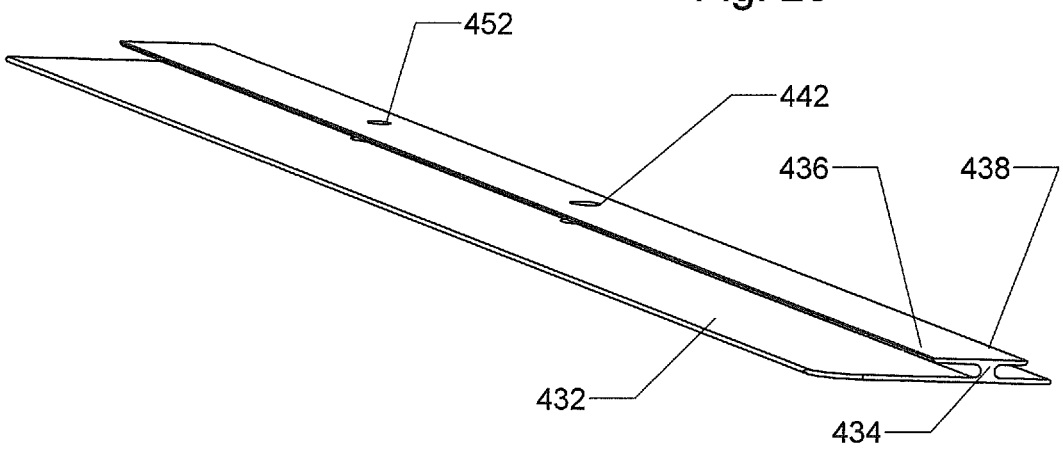
FIG. 23 shows a perspective view of a shelf used in the fence of FIGS. 18 and 19.

Main tube 426 also includes flanges or tracks 430 and 431 positioned below bottom wall 428 to support shelf 414. Shelf 414 includes a generally flat portion 432 and a mounting portion 434 that runs along the length of the shelf, as shown in FIGS. 22 and 23. Mounting portion 434 has a cross-sectional shape somewhat like a squatty "T" extending up from flat portion 432. Arms 436 and 438 extend out from the top of mounting portion 434 to define, along with flat portion 432, spaces or channels that receive flanges 430 and 431, respectively, as shown in FIGS. 24 and 25. Arm 436 fits over flange 430 when shelf 414 is extended, as shown in FIG. 25, and arm 438 fits over flange 431 when shelf 414 is retracted, as shown in FIG. 24. In the depicted embodiment, arm 436 is longer than arm 438, and flange 430 is longer than flange 431, in order to give as much support and alignment as possible to shelf 414 when extended.

Shelf 414 is secured to the fence by a screw 440 that passes through a hole 442 in the shelf (hole 442 passes through mounting portion 434 so that screw 440 does not interfere with either flange 430 or flange 431), and then threads into a screw boss 444 in the perimeter of projection 422 on the bottom of knob 416. Screw boss 444 is in the perimeter of projection 422 in order to provide an eccentric or off-center action that moves shelf 414 in and out when knob 416 is rotated. Specifically, turning knob 416 clockwise causes shelf 414 to extend out and to move somewhat toward the rear or distal end of the fence in a generally arcuate motion. Similarly, turning knob 416 counter-clockwise causes shelf 414 to retract beneath the fence and to move somewhat toward the front or proximal end of the fence in a generally arcuate motion. As shelf 414 moves in and out, arms 436 and 438 overlap flanges 430 and 431, respectively, to support and align the shelf.

Fence 412 includes a spring 450 that biases shelf 414 toward either the fully retracted or fully extended position, and then tends to hold the shelf in that position. Spring 450 is an elongate coil spring with one end attached to shelf 414 and the other end attached to fence 412. In the depicted embodiment, one end of spring 450 hooks through a hole 452 in the mounting portion of the shelf (a second hole may be drilled in the bottom of the shelf to provide clearance for the end of the spring that hooks over the edge of hole 452) and the other end of the spring hooks through a hole 454 in bottom wall 428 of main tube 426 of the fence. Multiple holes may be provided in either or both of the bottom wall or shelf so that springs of different sizes can be used and/or so that the force applied by the spring can be adjusted by securing one or both ends of the spring in different holes.

When knob 416 is rotated, screw 440 follows an arc or half circle around the axis of knob 416, which in turn causes shelf 414 to extend or retract and to move toward either the distal or proximal end of the fence, as explained. The motion of the shelf is generally translational, or in other words, the entire shelf moves generally in an arc without rotating. As the shelf starts moving, it stretches spring 450 until the shelf reaches what may be thought of as the apex of the arc (or half-way), at which point continued movement of the shelf will allow the spring to retract. In fact, once the shelf moves just past half-way, the spring will tend to pull the shelf to either the fully extended or fully retracted position. Knob 416 is adapted to rotate 180 degrees, and accordingly, if the knob is turned less than 90 degrees (i.e., less than half-way), the bias force of spring 450 tends to return the shelf to its prior position, either fully extended or fully retracted.

In the depicted embodiment, shelf 414 is made from extruded aluminum and flat portion 432 is on the order of 1 millimeter thick. That thickness allows the fence to be configured so that the shelf does not interfere with table 402 if the fence is moved over the table with the shelf extended and so that the plane of the shelf is only slightly above or nearly coplanar with the plane of the table.

Knob 416 is a molded plastic part and may include indentations or reliefs to maintain wall thickness so that sink holes do not develop in the part.

The top of fence 412 adjacent knob 416 may include a label 460 or other visual indicator that works with a mark on the knob 462 to indicate to a user whether the knob is in a position where the shelf if extended or retracted.

INDUSTRIAL APPLICABILITY

The fences described herein are applicable to woodworking power tool equipment, and particularly to table saws.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. No single feature, function, element or property of the disclosed embodiments is essential to all of the disclosed inventions. Similarly, the recitation of "a" or "a first" element, or the equivalent thereof, should be understood to include incorporation of one or more such elements, neither requiring nor excluding two or more such elements.

It is believed that the following claims particularly point out certain combinations and sub-combinations that are directed to disclosed inventions. Inventions embodied in other combinations and sub-combinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

The invention claimed is:

1. A fence for use with a table saw having a substantially planar work surface and a circular blade extending up through the work surface, and for use with a work piece, the fence comprising:

a front end;

a rear end;

an elongate portion extending between the front and rear ends, where the elongate portion has a face along which the work piece can slide when the fence is being used with the table saw and the work piece is being moved to contact the blade, and where the face is substantially perpendicular to the work surface when the fence is being used with the table saw; and a material support shelf between the front and rear ends, where the material support shelf has an extended position and a retracted position relative to the face, where the material support shelf moves between the extended and retracted positions substantially in a plane, where the material support shelf has a flat portion to support the work piece against gravity when the material support shelf is in the extended position and the fence is being used with the table saw and the work piece is being moved to contact the blade, where the material support shelf is substantially perpendicular to the face when the material support shelf is in the extended position, where the material support shelf in the extended position is located to form a corner region with the face so that the work piece can slide along the face while being supported by the material support shelf, and where the flat portion of the material support shelf is nearly coplanar with the work surface when the fence is being used with the table saw.

2. The fence of claim 1, further comprising a spring that biases the material support shelf toward either the extended or retracted position.

3. The fence of claim 1, where the material support shelf moves between the extended and retracted positions in a generally translational motion.

4. The fence of claim 1, where the flat portion is on the order of 1 millimeter thick.

5. The fence of claim 1, where the face has a bottom edge positioned to be adjacent the plane of the work surface when the fence is being used with the table saw, and where the flat portion of the material support shelf is below the bottom edge when the material support shelf is in the extended position.

6. A fence for use with a table saw having a work surface and a circular blade extending up through the work surface, and for use with a work piece, the fence comprising:

a front end;

a rear end;

an elongate portion extending between the front and rear ends, where the elongate portion has a face along which the work piece can slide when the fence is being used with the table saw and the work piece is being moved to contact the blade, and where the face is substantially perpendicular to the work surface when the fence is being used with the table saw;

a material support shelf between the front and rear ends, where the material support shelf has an extended position and a retracted position relative to the face, where the material support shelf has a flat portion to support the work piece against gravity when the material support shelf is in the extended position and the fence is being used with the table saw and the work piece is being moved to contact the blade, and where the material support shelf is substantially perpendicular to the face to form a corner region with the face when the material support shelf is in the extended position so that the work piece can slide along the face while being supported by the material support shelf; and a knob associated with the elongate portion, where the material support shelf moves between the extended and retracted positions upon movement of the knob by a user.

7. The fence of claim 6, where the knob is positioned in a socket in the elongate portion.

8. The fence of claim 6, where the elongate portion has a top, and where the knob is positioned below the top of the elongate portion.

9. The fence of claim 6, further comprising an eccentric, and where movement of the knob causes the eccentric to extend and retract the material support shelf.

10. The fence of claim 6, where the face has a bottom edge, and where the material support shelf is below the bottom edge when the material support shelf is in the extended position.

11. The fence of claim 6, further comprising a spring that biases the material support shelf toward either the extended or retracted position.

12. The fence of claim 6, where the material support shelf extends and retracts in a generally translational motion.

13. The fence of claim 6, where the material support shelf includes a flat portion on the order of 1 millimeter thick.

14. A fence for use with a table saw, the fence comprising:

a front end;

a rear end;

an elongate portion extending between the front and rear ends, where the elongate portion has a face along which a work piece can slide, and where the face has a bottom edge; and a material support shelf adjacent the bottom edge between the front and rear ends and generally perpendicular to the face, where the material support shelf has an extended position and a retracted position relative to the face, where the material support shelf moves between the extended and retracted positions substantially in a plane, where the material support shelf has a flat portion to support the work piece against gravity when the material support shelf is in the extended position, and where the material support shelf in the extended position is located to form a corner region with the face so the work piece can slide along the face while the work piece is supported against gravity by the material support shelf.

* * * * *